US006323827B1

(12) United States Patent
Gilger et al.

(10) Patent No.: US 6,323,827 B1
(45) **Date of Patent: *Nov. 27, 2001**

(54) MICRO FOLD REFLECTOR

(75) Inventors: L. Dwight Gilger, Torrance; Mark W. Thomson, Ventura; John C. Gereau, Santa Monica, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/479,839

(22) Filed: Jan. 7, 2000

(51) Int. Cl.[7] ..... H01Q 15/20

(52) U.S. Cl. ..... 343/915; 343/912; 343/882; 343/880; 52/111

(58) Field of Search ..... 343/915, 880, 343/881, 840, 878, 882, 912; 52/111, 646

(56) References Cited

U.S. PATENT DOCUMENTS 4,475,323 * 10/1984 Schwartzberg et al. ..... 52/111
5,228,258 * 7/1993 Onoda et al. ..... 52/646
5,680,145 * 10/1997 Thomson et al. ..... 343/915
6,028,570 * 2/2000 Gileger et al. ..... 343/915

* cited by examiner

*Primary Examiner*—Don Wong
*Assistant Examiner*—Ephrem Alemu
(74) *Attorney, Agent, or Firm*—McAndrews, Held & Malloy, Ltd.

(57) ABSTRACT

A perimeter truss structure (103) that may be used, for example, to support an RF reflector may include multiple deployed bays (200) arranged in a ring. Each deployed bay (200) includes a first upper horizontal support member (726) attached to a first vertical support member (706) and collapsible on a first joint (728) translating on a second vertical support member (708), as well as a first lower horizontal support member (714) attached to the second vertical support member (708) and collapsible on a second joint (744) translating on the first vertical support member (706). The first and second vertical support members (706, 708) define a ring inside (122) and a ring outside (124). The first upper horizontal support member (712) is disposed on one ring side (e.g., the outside), while the first lower horizontal support member (714) is disposed on the opposite ring side. The horizontal support members (712, 714) (which are oriented vertically in the stowed position) are thus non-interfering in the stowed position.

37 Claims, 16 Drawing Sheets

MICRO FOLD REFLECTOR

BACKGROUND OF THE INVENTION

The present invention relates to perimeter truss structures for space borne antennas. In particular, the present invention relates to a deployable perimeter truss structure that folds into a compact volume for launch.

Industry has continued to improve space deployable reflector antennas for over 30 years. In the past, reflector antenna designs included a cantilever radial rib structure that supported an elastic shaped mesh. However, the radial rib structure required elaborate manufacturing, assembly, and alignment techniques, while the elastic mesh required a great deal of time, labor, and expense to attach. Because the rib structure had an inherently high weight, some past reflector antennas attempted to substitute a labyrinth of expensive caternaries including radial and cross cords to develop the density of control points required to shape the elastic mesh properly. A common difficulty associated with these past approaches, however, was that the resulting structures suffered from high weight and large stowed volume.

Space borne antennas, of course, reach orbit in a launch vehicle. Launch vehicles are extremely expensive, and any reduction in payload size and weight generally results in reduced launch cost. Past radial rib structures in particular, however, required very large volume inside a launch vehicle shroud. As a result, larger shrouds and larger launch vehicles were required.

The cost difference between launch vehicles can be enormous. As one example, a satellite launched by an ATLAS rocket incurs an approximately $185 million launch cost, while a satellite with an antenna that requires a larger TITAN launch vehicle incurs an approximately $400 million launch cost. Thus, although large antennas are generally desirable, the large stowed size and weight of such antennas, in the past, presented an enormous launch and manufacturing cost hurdle.

A need has long existed for a cost effective, lightweight, large aperture antenna support structure that folds into a compact volume for launch.

BRIEF SUMMARY OF THE INVENTION

One aspect of the present invention is a folding perimeter truss structure suitable for deployment in outer space.

Another aspect of the present invention is a folding perimeter truss structure that occupies less stowed volume than previous folding perimeter truss structures.

A further aspect of the present invention is a folding perimeter truss structure that uses translating joints to allow the truss structure to collapse into a volume much smaller than previous antenna structures.

One feature of the present invention is a folding perimeter truss structure that may be used to support traditional parabolic reflectors.

An attribute of the present invention is a folding perimeter truss structure that optionally includes extension spars above and below deployable bays to support a reflector surface.

Another attribute of the present invention is a folding perimeter truss reflector formed from individual bays sharing common structure, and in which certain bay support members are disposed on opposite sides of the truss reflector to allow the reflector to fold into a very compact volume without interference between the support members.

A preferred embodiment of the present invention provides a perimeter truss structure that may be used, for example, to support an RF reflector. The truss structure includes multiple deployed bays arranged in a ring. Each deployed bay includes a first upper horizontal support member attached to a first vertical support member and collapsible on a first joint translating on a second vertical support member, as well as a first lower horizontal support member attached to the second vertical support member and collapsible on a second joint translating on the first vertical support member.

The first and second vertical support members define a ring inside and a ring outside. The first upper horizontal support member is disposed on one ring side (e.g., the outside), while the first lower horizontal support member is disposed on the opposite ring side. The horizontal support members (which are oriented vertically in the stowed position) are thus non-interfering in the stowed position.

The truss structure optionally includes extension spars that extend out of the ring from above, below or both above and below the deployed bays when the ring is deployed. Adjacent bays may share support structure. Thus, for example, the perimeter truss structure may further include a third vertical support member, a second upper horizontal support member attached to the third vertical support member and collapsible on the first translating joint on the second vertical support member, as well as a second lower horizontal support member attached to the second vertical support member and collapsible on a third translating joint on the third vertical support member.

Each deployable bay may include supporting shear lines cross connected between the first upper horizontal support member and the first lower horizontal support member. Additionally, the truss structure preferably includes, for each bay, cross connected extension spar guy lines connected between the downwardly extending extension spars and the upper horizontal support members and cross connected extension spar guy lines connected between the upwardly extending extension spars and the lower horizontal support members.

A ring tension line is optionally provided around the inside of the ring to add additional stiffness to the truss structure. The tension line may be coupled to each of the deployable bays through a tension line truss structure. As an example, the tension line truss structure may form a pyramidal tension line truss structure connected to each bay.

Another preferred embodiment of the present invention provides a deployable perimeter truss structure. The deployable truss structure includes collapsed bays arranged in a ring, the collapsed bays including at least first, second, and third vertical support members. The vertical support members delineate a first bay and a second bay with the second vertical support member shared between the first bay and second bay.

The first bay includes a first upper horizontal support member attached to the first vertical support member and collapsed on a first joint translating on the second vertical support member as well as a first lower horizontal support member attached to the second vertical support member and collapsible on a second joint translating on the first vertical support member. Similarly, the second bay includes a second upper horizontal support member attached to the third vertical support member and collapsed on the first joint translating on the second vertical support member and a second lower horizontal support member attached to the second vertical support member and collapsed on a third joint translating on the third vertical support member.

In the deployable truss structure, the vertical support members define a ring inside and a ring outside. In the stowed position, the first and second upper horizontal support members are disposed in a vertical orientation. Similarly, the first and second lower horizontal support members are disposed in a vertical orientation opposite the first and second upper horizontal support members.

Multiple pulleys are employed that either ride with the joints or that are attached at ends of the vertical support members. A deployment cable runs over and under certain of the pulleys associated with the upper horizontal support members. A winder may then activate to pull in the deployment cable to lift the first joint into a deployed position. Because the collapsed bays are connected to one another around the ring, the winder action not only lifts the first joint into place, but also every other joint in the deployable truss structure. A redundant deployment cable may be provided for the lower horizontal support members.

In addition, redundant synchronization cables may be connected between the upper horizontal support members and the lower horizontal support members. The synchronization cables run over and under certain pulleys as well, and react to the winder action to ensure that each translating joint moves in synchronism with every other translating joint and also provide for deployment should one of the deployment cables break.

The deployable perimeter truss structure may further include shear lines cross connected between the upper horizontal support members and the lower horizontal support members. Additionally, extension spars are provided that telescope out of the end of certain vertical support members or that alternatively ride along with the joints during deployment to extent into the ring outside, but above or below the horizontal support members. Thus, a caternary system coupled to the extension spars may be included to support a reflective surface.

Because the extension spars preferably extend above and below the horizontal support members, the deployable truss structure may support an elastic Radio Frequency (RF) reflective surface (e.g., coupled to the upwardly extending extension members) as well as a shaping surface (e.g., coupled to the downwardly extending extension members). Drop ties are provided between the reflective surface and the shaping surface at control points to form the shape of the reflective surface.

DETAILED DESCRIPTION OF THE INVENTION

Figure 1A:
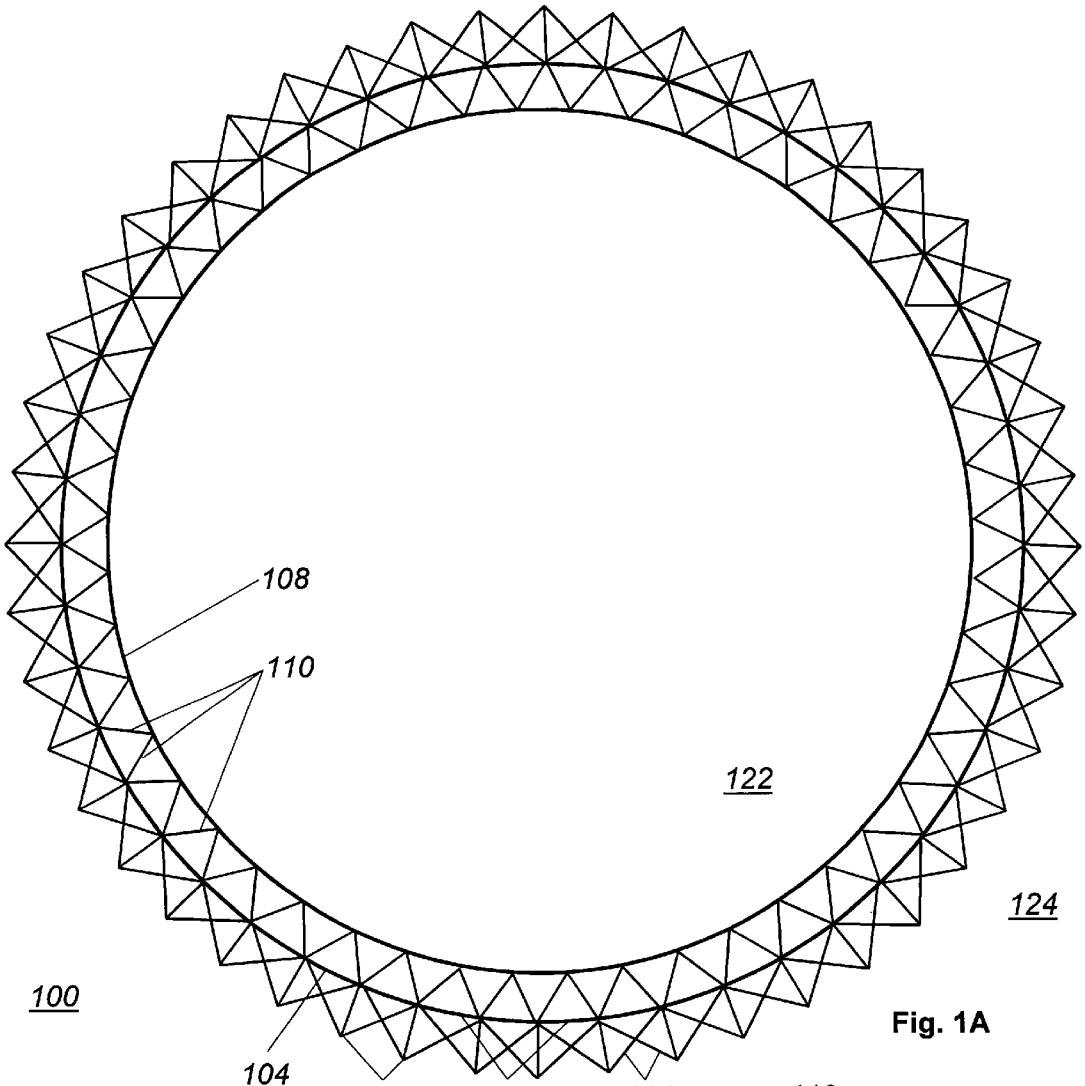
FIGS. 1A–B illustrate a top down wire frame view and a side wire frame view of a deployed perimeter truss structure.
Figure 1B:
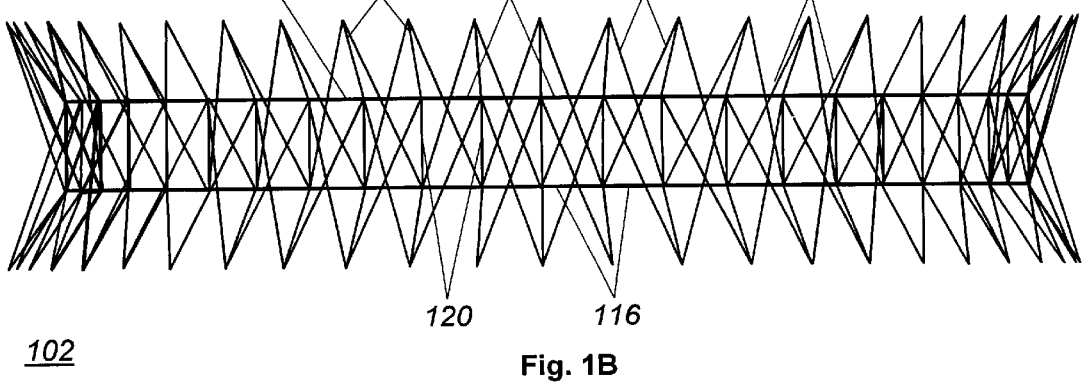

Turning now to FIG. 1, that figure shows a top view 100 and a side view 102 of a perimeter truss structure 104. The truss structure 104 is divided into repeating rectangular structures or subdivisions referred to as bays 106 arranged to form a closed a ring. As illustrated in FIG. 1, the perimeter truss structure 104 includes a hoop line 108 connected through pyramidal tension structures 110 to the bays 106. The truss structure 104 illustrated also includes extension spars 112 and extension spar guy lines 114.

The bays 106 are formed using lower horizontal support members 116, upper horizontal support members 118, and vertical support members 120. The horizontal and vertical support members 116–120 are present in a repeating pattern around the ring to form the bays 106, with adjacent bays 106 sharing a common vertical support member. The vertical support members 120 generally define a ring inside 122 and a ring outside 124.

As will be explained in more detail below, the extension spars 112 are preferably connected to extend away from the ring (e.g., into the ring outside 124). That is, the extension spars 112 point away from the center of the ring. The extension spars 112 are optional, however, and thus the perimeter truss structure 104 may include no extension spars, upward and outward pointing extension spars, downward and outward pointing extension spars, or one or more of both. As will be explained in more detail below, the extension spars 112 may support virtually any surface, although in most cases the extension spars 112 will support an elastic RF reflective surface for antenna applications. When the extension spars are omitted, however, the vertical support members 118 may directly support a reflective surface. The extension spars 112 may be included, for example, when the supported surface requires greater depth of curvature, and therefore a taller overall support structure.

Similarly, the hoop line 108 and pyramidal tension structures 110 are optional, but preferably included when additional stiffness in the perimeter truss structure 104 is desirable. To this end, the hoop line 108 and pyramidal tension structures 110 provide a reduction in torsion effects that may induce back and forth rotation of the perimeter truss structure 104. Whether or not a particular perimeter truss structure and antenna implementation will experience such torsion effects may be evaluated using computer modeling of the structure.

The horizontal and vertical support members 116–120 are preferably hollow and formed using a low Coefficient of Thermal Expansion (CTE) material As an example, a graphite resin system may be used to form the horizontal and vertical support members 116–120. The pyramidal tension structures 110, extension spar lines 114, and shear lines (each described in more detail below) for each bay may be formed from unidirectional graphite filament lines for low CTE and low creep properties.

Figure 2:
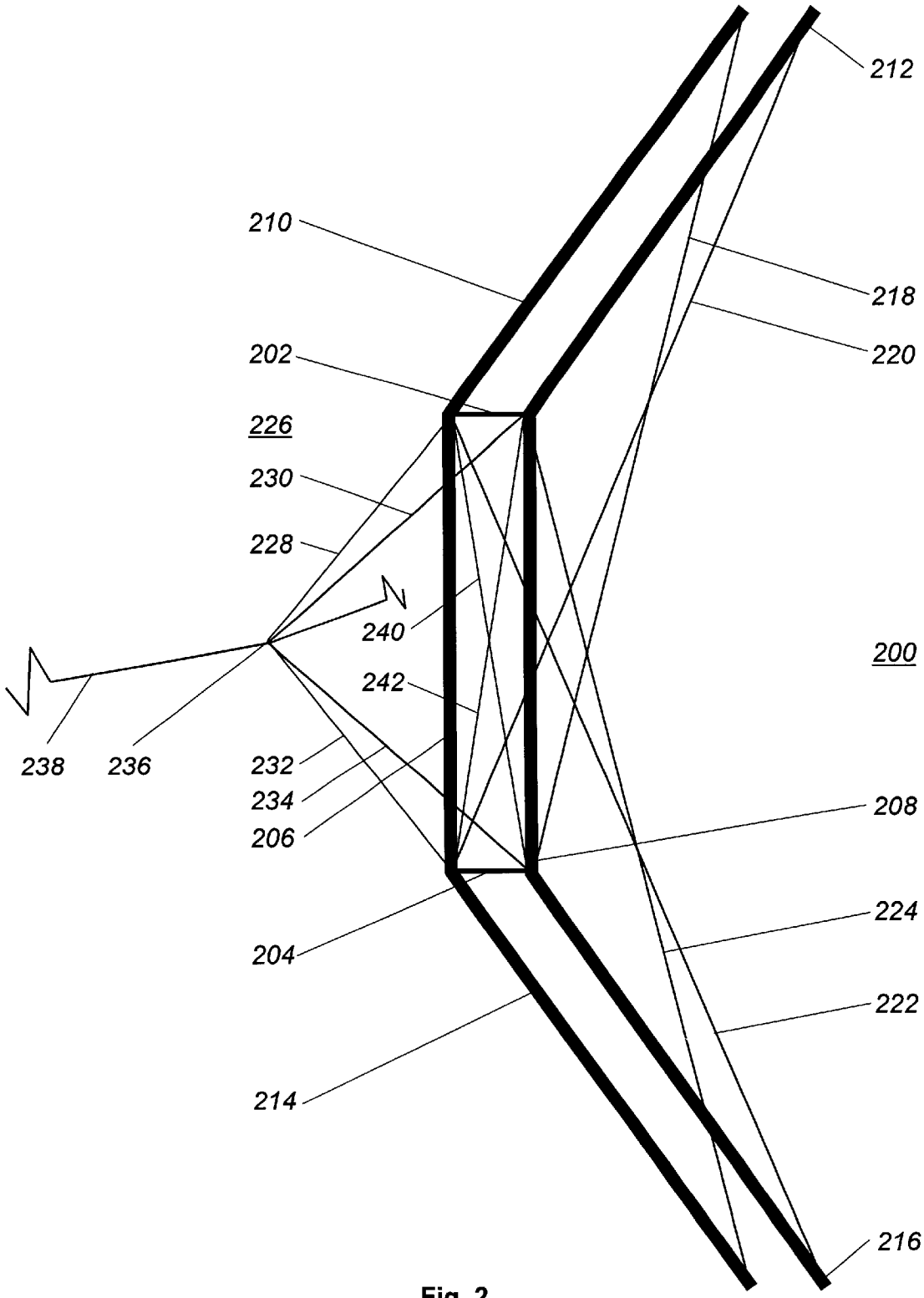
FIG. 2 shows one of the deployed bays used to form the perimeter truss structure, including extension spars.

With reference now to FIG. 2, that figure illustrates a single deployed bay 200 of the perimeter truss structure 104. The bay 200 includes an upper horizontal support member 202, a lower horizontal support member 204, and first and second vertical support members 206 and 208. Also illustrated are first and second upwardly extending extension spars 210 and 212 and first and second downwardly extending extension spars 214 and 216. Associated extension spar guy lines 218, 220, 222, and 224 connect the extension spars 210–216 to the horizontal and vertical support members 202–208.

FIG. 2 also shows a pyramidal tension structure 226 which is formed, preferably, from four tension lines 228, 230, 232, and 234. Additionally, the hoop line 238 connects to the pyramidal tension structure 226 at the connection point 236. The connection point 236 thereby defines the apex of the pyramidal tension structure 226.

Further illustrated in FIG. 2 are cross connected shear lines 240 and 242. The shear lines 240 and 242 provide, upon deployment of the perimeter truss structure, stability for the horizontal and vertical support members 202–208. Extra stability is generally desirable because the horizontal and vertical support members 202–208, as illustrated in more detail below, are connected together with pivots and translating joints. As noted above, the shear lines 240–242 may be formed from unidirectional graphite filamentary lines. A regular repeating structure of horizontal and vertical support members 202–208 forms a series of bays 106 arranged in a ring.

The hoop line 238 may be secured to the pyramidal tension structure 226 by a split ring with each tension line 228–234 having an end fitting clipping onto the ring. Preferably, however, the end of each tension line 228–234 is threaded and thereby secured into a joint on the hoop line 238 such that each fiber in each tension line 228–234 carriers part of the load. The tension lines 228–234 may be secured to the horizontal and vertical support members 202–208 using a threaded fitting as well. In addition, two lock nuts are then provided to adjust tension load on the tension lines 228–234 with one lock nut serving to jam the connection so that the connection does not loosen. The shear lines 240 and 242 may be secured to the horizontal and vertical support members 202–208 in the same fashion as the tension lines 228–234. The extension spar lines 218–224 may be secured to the horizontal and vertical support members 202–208 by threading the ends of the spar lines, and coupling them into fittings on the horizontal and vertical support members 202–208.

Numerous bays 200 are arranged in a ring for the perimeter truss structure 104. Thus, the bay inside represents an area that will eventually become the inside of the ring. Similarly, the bay outside represents an area that will be outside of the ring.

Figure 3:
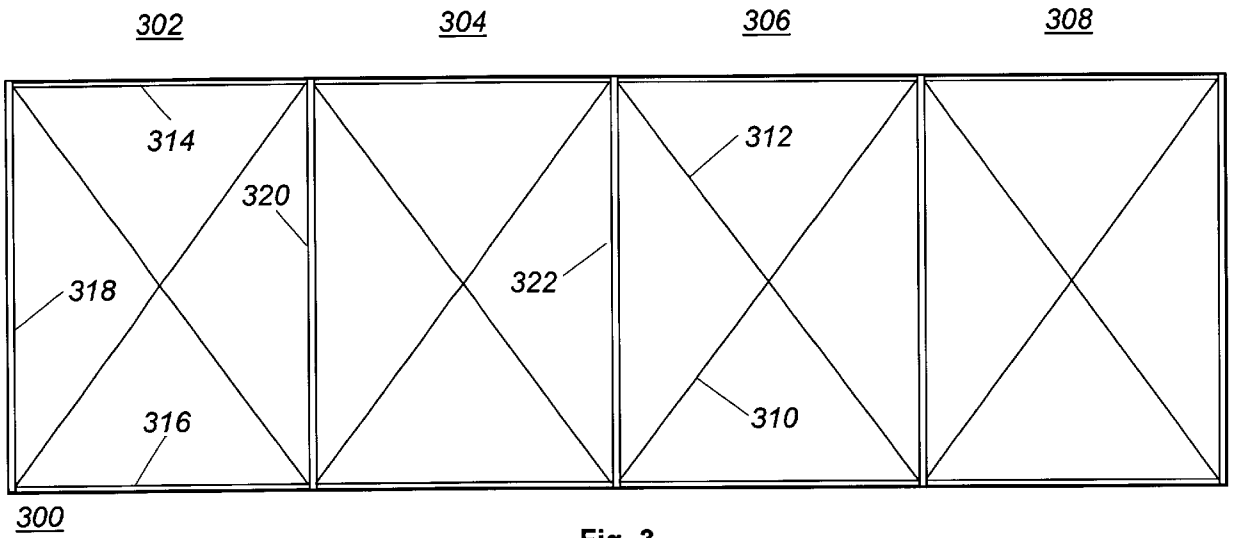
FIG. 3 depicts a side view of four fully deployed bays without extension spars.

Turning to FIG. 3, that figure illustrates a perimeter truss section 300 including four deployed bays 302, 304, 306, and 308. Each bay 302–308 includes cross connected shear lines (two of which are designated as the shear lines 310 and 312). Each bay is formed from an upper horizontal support member (e.g., the upper horizontal support member 314), a lower horizontal support member (e.g., the lower horizontal support member 316), and two vertical support members (e.g., the vertical support members 318 and 320). Note that the bay 304 shares the vertical support member 320 with its adjacent bay 302. In turn, the bay 306 shares the vertical support member 322 with its adjacent bay 304. The sharing of vertical support members continues in this fashion around the entire perimeter truss structure 104.

As illustrated, the perimeter truss section 300 does not include extension spars nor hoop line and pyramidal tension structures. The extension spars may be added, for example, when additional total deployed height is desired. The hoop line, and pyramidal tension structure may be added, for example, when additional stiffness in the perimeter truss structure as a whole is desired. The omission of the extension spars, hoop line, and pyramidal tension structures serve to clarify the illustration and discussion of the manner in which the bays collapse along translating joints, as illustrated in FIGS. 4–6.

Figure 4:
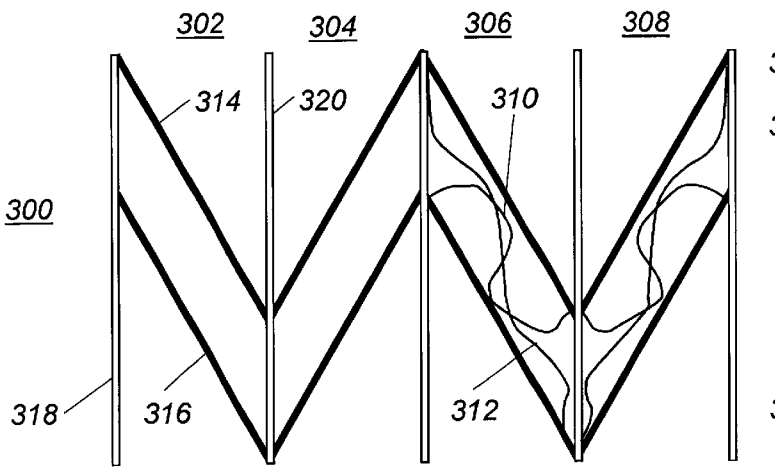
FIGS. 4–6 illustrate folding of the four bays into a compact volume.

Turning now FIG. 4, that figure shows the perimeter truss section 300 partially deployed (unlike the full deployment illustrated in FIG. 3). Thus, FIG. 4 shows the bays 302, 304, 308, and 308 in a partially collapsed state. For reference purposes, the corresponding cross connected shear lines 310 and 312, the upper horizontal support member 314, the horizontal support member 316, and the two vertical support members 318 and 320 are labeled in FIG. 4.

As will be discussed in more detail below with regard to FIG. 7, translating joints and fixed pivoting joints allow the perimeter truss section 300 to collapse into a very compact volume. One significant factor in reducing the stowed volume is that the upper horizontal support members (e.g., the upper horizontal support member 314) are oriented on the opposite side of the lower horizontal support members (e.g., the lower horizontal support member 316). In other words, the upper and lower horizontal support members are taken out of the plane of the vertical support members. The vertical support members may then come extremely close together in the stowed position, allowing very volume efficient stowage of the perimeter truss reflector.

Figure 5:
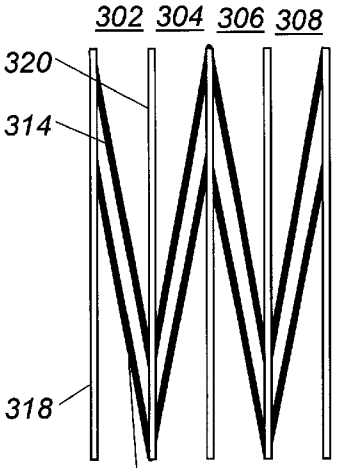
Figure 6:
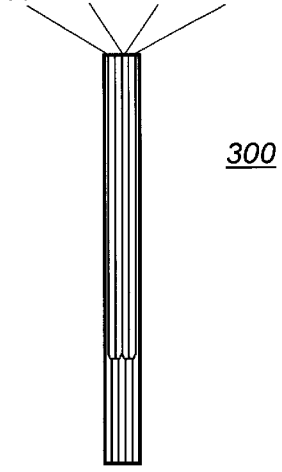

First, however, with reference to FIG. 5, the perimeter truss section 300 is shown in a further state of collapse. The shear lines 310 and 312 are still present, but are not shown in FIG. 5 in order to clarify the illustration. Note that the upper and lower horizontal support members 314 and 316 (as well as every other horizontal support member) move toward a vertically oriented position when the perimeter truss section 300 is collapsed. The upper and lower horizontal support members 314 and 316 reach a vertical orientation when the perimeter truss section 300 is completely collapsed, as shown in FIG. 6.

With regard to FIG. 6, the perimeter truss section 300 is illustrated in its final state of collapse. Of course, the bays 302, 304, 306, and 308 may be restored by opening the perimeter truss section. The position of the bays 302, 304, 306, and 308 in the collapsed state are indicated in FIG. 6 as the collapsed bays 602, 604, 606, and 608. The mechanism by which the horizontal support members 314 and 316 allow the bays 302, 304, 206, and 308 to collapse and expand is illustrated in greater detail in FIG. 7.

Figure 7:
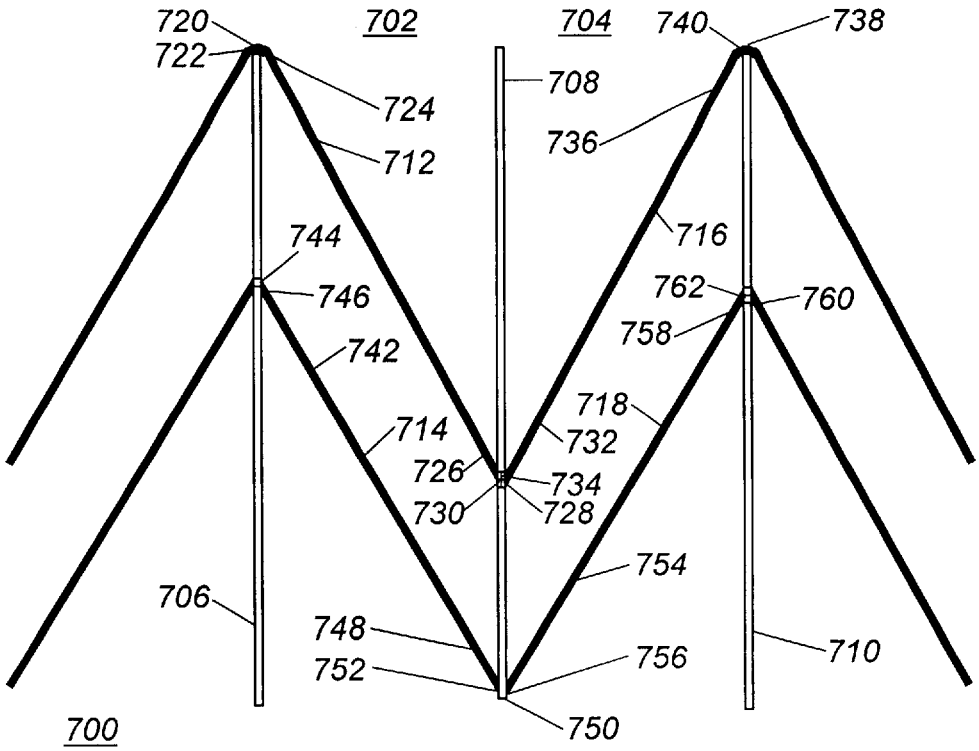
FIG. 7 shows a closer view of the translating joint and non translating joint structure of the horizontal support members.

With reference now to FIG. 7, that figure illustrates a perimeter truss section 700 including a first bay 702 and a second bay 704. The left and right sides of the first bay 702 and defined by the first vertical support member 706 and the second vertical support member 708. The left and right sides of the second bay 704 are defined by the second vertical support member 708 and the third vertical support member 710. The top and bottom sides of the first bay 702 are defined by the first upper horizontal support member 712 and the first lower horizontal support member 714. Similarly, the top and bottom sides of the second bay 704 are defined by the second upper horizontal support member 716 and the second lower horizontal support member 718.

Note that a left end 724 of the first upper horizontal support member 712 is pivotably attached to the fixed joint 720, and in particular is attached to the fixed joint 720 using a pivot pin 722. On the other hand, the right or opposite end 726 of the first upper horizontal support member 712 is pivotably attached to the translating joint 728 using the pivot pin 730. In a similar fashion, a left end 732 of the second upper horizontal support member 716 is attached to the translating joint 728 using a pivot pin 734. An opposite end 736 of the second upper horizontal support member 716 is pivotably attached to a fixed joint 738 using the pivot pin 740.

With regard to the lower horizontal support members 714 and 718, a left end 742 of the first lower horizontal support member 714 is pivotably attached to a translating joint 744 using the pivot pin 746. The right end 748 of the first lower horizontal support member 714 is pivotably attached to the fixed joint 750 using the pivot pin 752. In a similar fashion, a left end 754 of the second lower horizontal support member 718 is attached to the fixed joint 750 using a pivot pin 756. An opposite end 758 of the second lower horizontal support member 718 is pivotably attached to a translating joint 760 using a pivot pin 762.

The pattern of sliding joints and fixed joints repeats regularly along the entire perimeter truss structure 104. Thus, there is a sliding joint on every other vertical support member for the upper horizontal support members that alternates with a fixed joint on every other vertical support member for the upper horizontal support members. Similarly, there is a sliding joint on every other vertical support member for the lower horizontal support members that alternates with a fixed joint on every other vertical support member for the lower horizontal support members. Where an end of an upper horizontal support member attaches to a sliding joint, the corresponding end of a lower horizontal support member attaches to a fixed joint.

Note that the translating joints 728, 744, 760 provide linear motion along their respective vertical support members 706–710. To that end, the translating joints 728, 744, 760 may be implemented as sliding joints 728, 744, 760 (e.g., as a larger tube wrapped around its corresponding vertical support member 706–710). Alternatively, the sliding joints 728, 744, 760 may be implemented by forming rails along the vertical support members 706–710 and providing wheels for the sliding joint structure to allow translation along the rails. A translating joint is illustrated in more detail below in FIG. 10.

When the perimeter truss section 700 deploys, the ends of the horizontal support members attached to fixed joints pivot to follow the ends of the horizontal support members attached to the translating joints. Thus, for example, as the translating joint 728 moves toward the top of the vertical support member 708, the left end 724 of the first upper horizontal support member 712 allows the first upper horizontal support member 712 to rotate into a horizontal position (e.g., as shown in FIG. 3 by the horizontal support member 314).

As illustrated in FIG. 7, the fixed joints 720 and 738 and the translating joint 728 (and indeed all joints for the upper horizontal support members) are oriented to face away from the ring inside. On the other hand, the fixed joint 750 and the translating joints 744 and 760 are oriented to face the opposite direction, namely toward the ring inside. Thus, the upper horizontal support members are disposed out of the plane of the vertical support members 706–710 away from the ring, while the lower horizontal support members are disposed out of the plane of the vertical support members 706–710 toward the ring. Alternatively, the upper horizontal support members may face the ring inside, while the lower horizontal support members face the ring outside. Thus, as will be seen below, the upper horizontal support members, vertical support members, and lower horizontal support members will form three concentric rings of support structure when the perimeter truss structure is stowed.

Figure 8:
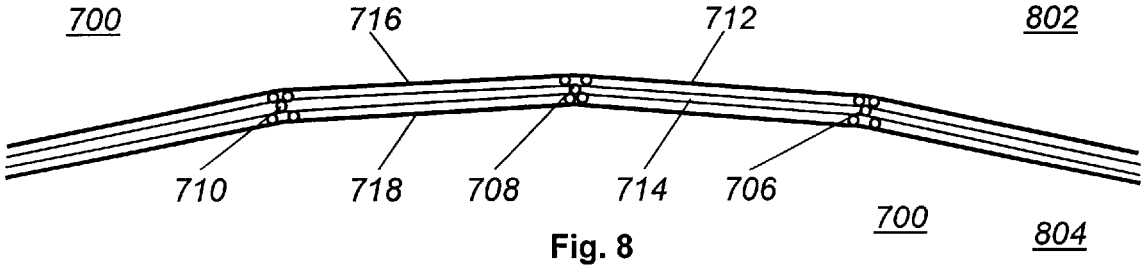
FIG. 8 shows a top view of a several bays.

A top view of the perimeter truss section 700 may be seen in FIG. 8. For reference purposes the ring inside is designated 804 and the ring outside is designated 802. The structural elements illustrated in FIG. 7 are correspondingly labeled in FIG. 8. The top view shown in FIG. 8 more clearly illustrates the out of plane positioning of the upper horizontal support members 712 and 716 and the lower horizontal support members 714 and 718. As noted above, the perimeter truss structure forms a triple dense stowed configuration.

Figure 9:
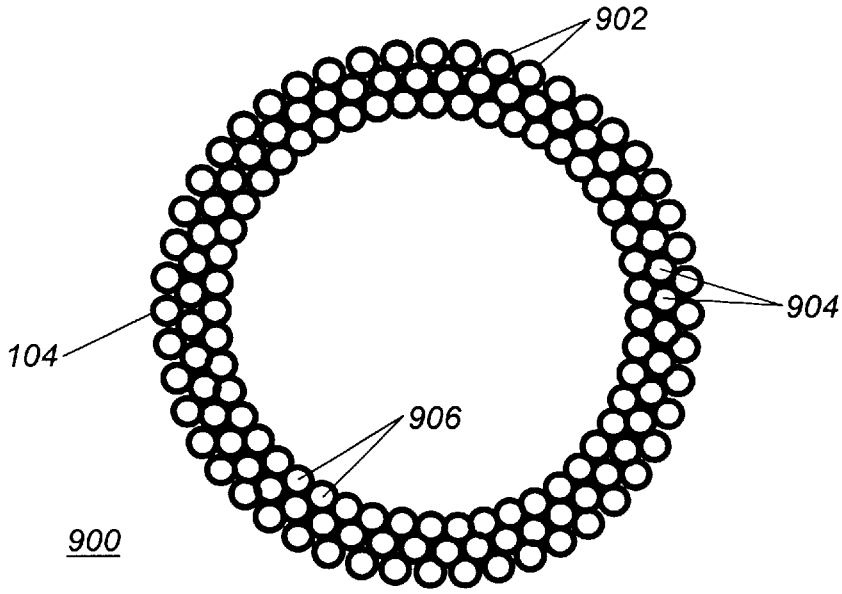
FIG. 9 shows a top view of the truss structure in a stowed (folded) configuration.

FIG. 9 illustrates a top down view of the stowed configuration 900 of the perimeter truss structure 104. FIG. 9 illustrates the stowed positions of the upper horizontal support members (two of which are designated as upper horizontal support members 902), the vertical support members (two of which are designated as vertical support members 904) as well as the lower horizontal support members (two of which are designated as lower horizontal support members 906). As noted above, the translating joints and the out of plane alignment of the horizontal support members allows the perimeter truss structure 104 to achieve the compact volume stowage configuration illustrated in FIG. 9.

Figure 10:
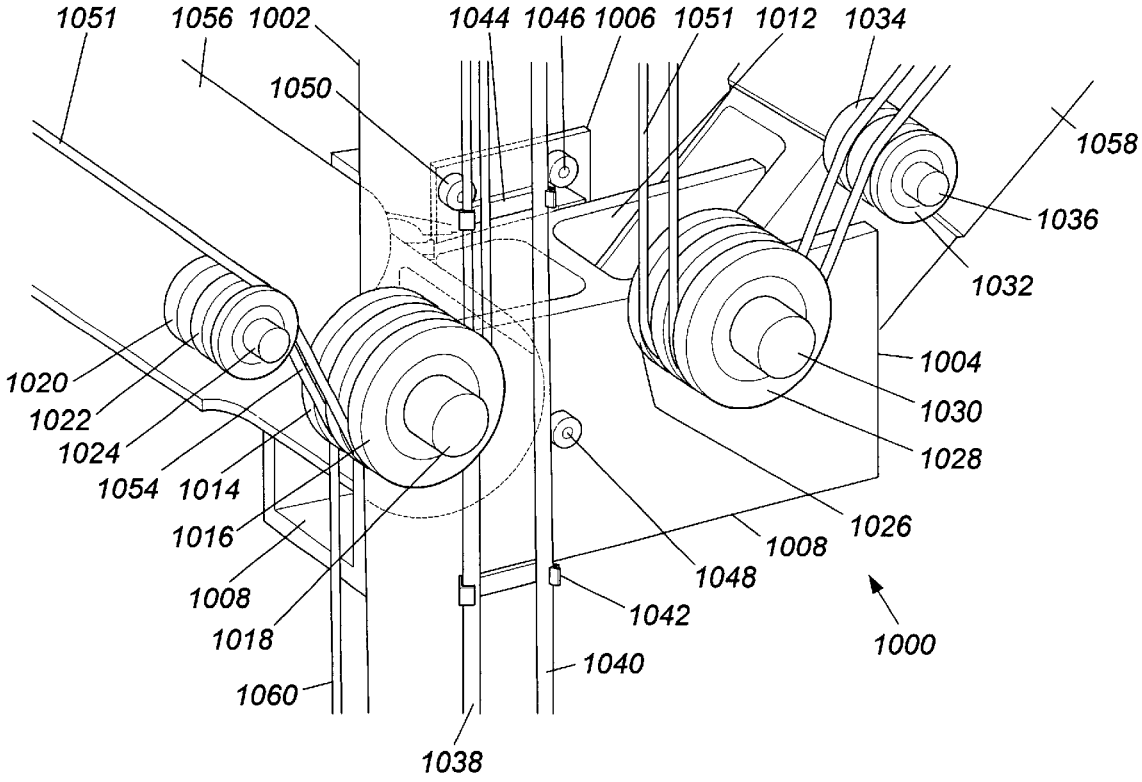
FIG. 10 shows a translating joint and pulley system.

Turning now to FIG. 10, that figure illustrates an embodiment of a joint and rail system 1000 that may be used for a translating joint (e.g., the translating joint 738 described above with reference to FIG. 7). FIG. 10 shows a vertical support member 1002 to which a translating joint 1004 couples using a miniature trolley 1006. The translating joint couples using a miniature trolley 1006. The translating joint 1004 includes an H-shaped bracket 1008 with a left recess 10lO and a right recess 1012. The left recess 1010 includes two pulleys 1014 and 1016 on a common pivot pin 1018, as well as positioning pulleys 1032 and 1034 supported on a common pivot pin 1036. Each of the pulleys preferably rotates on ball bearings and has a plastic shaping sleeve.

With regard to the miniature trolley 1006, a left rail 1038 and a right rail 1040 run along the vertical support member 1002. Supporting graphite epoxy clips along the rails (e.g., the clips 1042 and 1044) allow the left rail 1038 and right rail 1040 to slip as the left rail 1038 and right rail 1040 heat and cool in order to prevent deformation of the vertical support member 1002. The miniature trolley 1006 includes four cupped wheels which ride along the left and right rails 1038 and 1040.

FIG. 10 designates three of the wheels with reference numerals 1046, 1048, and 1050. While the wheels 1046, 1048, and 1049 ride along the inside of the left rail 1038 and 1040 (to avoid interference with the clips 1042 and 1044), the wheels 1046, 1048, and 1050 may instead ride along the outside of the left rail 1038 and the right rail 1040 when the clips instead connect inside the left rail 1038 and right rail 1040. FIG. 11, discussed below, presents a view of both configurations.

With continued reference to FIG. 10, the routing of a deployment cable 1049 and first and second synchronization cables 1052 and 1054 are shown. In particular, the deployment cable 1051 runs down the inside of the upper horizontal support member 1056, over the pulley 1022, and under the pulley 1016. The deployment cable 1051 then continues up the outside of the vertical support member 1002 where it runs over a pulley (not shown) and back down under the pulley 1028. The deployment cable 1051 continues over the positioning pulley 1032 (which positions the deployment cable 1051 near the center of the upper horizontal support member 1058) and continues up the inside of the upper horizontal support member 1058.

The deployment cable 1051 is thus routed in the fashion described below with regard to the deployment cable 1234 in FIG. 12. Note also that an additional synchronization cable 1060 attaches to the translating joint 1004. The additional synchronization cable 1060 may, for example, represent the synchronization cable 1228 described in more detail below in FIG. 12.

Thus, when the deployment cable 1051 winds up, it exerts an upward force on the translating joint 1004. The translating joint therefore rolls along the left and right rails 1038 and 1040 to move up the vertical support member 1002. The synchronization cable 1060 then pulls up to apply a downward force on a translating joint shared between adjacent bays (e.g., the translating joint 728 for the bays 702 and 704).

The translating joint 1004 may be used as a fixed joint by eliminating the miniature trolley and bonding the translating joint to the vertical support member. An example is shown below in FIG. 11A.

Figure 11A:
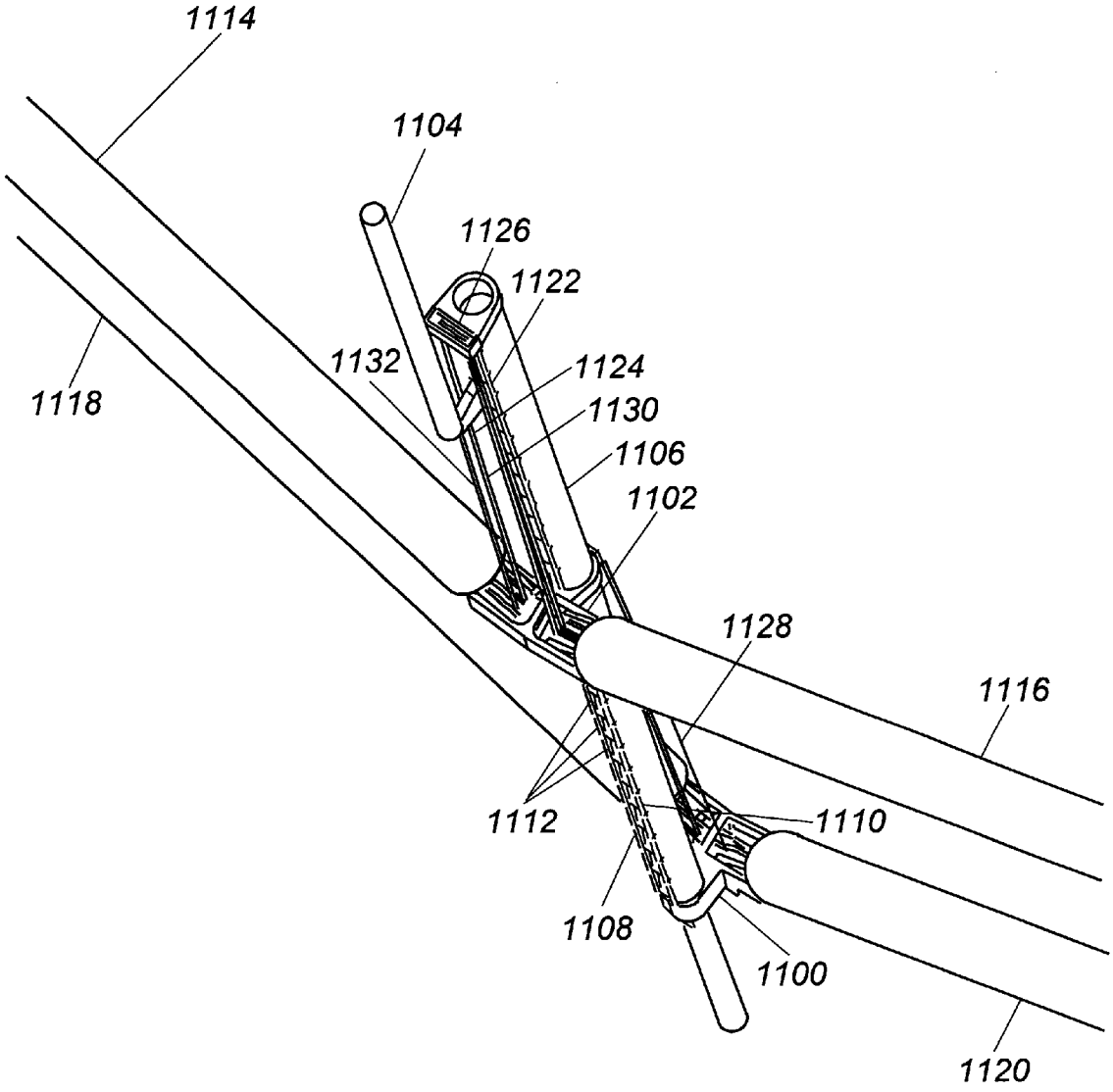
FIGS. 11A–C depict the structure of an extension spar, translating joint, and a non-translating joint of the perimeter truss structure.

With regard to FIG. 11A, that figure illustrates an embodiment of a fixed joint 1100, a sliding joint 1102, and a translating extension spar 1104. A vertical support member 1106 supports the fixed joint 1100, the sliding joint 1102, and the translating extension spar 1104. A left rail 1108 and a right rail 1110 run along the vertical support member 1106. Inner supporting clips 1112 allow the left rail 1108 and right rail 1110 to expand and contract without deforming the vertical support member 1106.

The first upper horizontal support member 1114 and second upper horizontal support member 1116 connect to the sliding joint 1102. In particular, the sliding joint 1102 may be implemented as shown above in FIG. 10. The first lower horizontal support member 1118 and second lower horizontal support member 1120 connect to the fixed joint 1100. The fixed joint 1100 may be implemented using the sliding joint shown above in FIG. 10, eliminating the trolley structure 1006, and instead bonding the joint to the vertical support member 1106.

The translating extension spar 1104 incorporates its own miniature trolley 1122, and clevis joint 1124. To that end, the miniature trolley 1122 includes cupped wheels that ride along the left and right rails 1108 and 1110. The clevis joint 1124 allows the translating extension spar 1104 to rotate into place (guided by the extension spar guidelines). The clevis joint 1124, however, includes a stop that prevents the translating extension spar 1104 from rotating beyond a predetermined limit, for example, 30 degrees.

An extension spar cable may be used to pull the extension spar 1104 into place. In particular, an extension spar cable may be attached to the translating joint 1102, routed under a pulley near the fixed joint 1100, back up and over a pulley near the fixed pulley 1126 and connected to the miniature trolley 1122. When the translating joint 1102 moves upward along the vertical support member 1106 the extension spar cable pulls the miniature trolley 1122 into position. Depending on the length of the extension spar 1104, a disengagement mechanism may also be used to prevent translation of the extension spar 1104 past a predetermined point on the vertical support member 1106.

FIG. 11A additionally shows a lower synchronization cable 1128 routed through the lower fixed joint 1100 and attached to the translating joint 1102. Furthermore, FIG. 11A illustrates a deployment cable 1130 and an upper synchronization cable 1132. The manner in which the deployment cables and the synchronization cables are routed through the perimeter truss structure 104 may be found below in the discussion of FIG. 12.

Figure 11B:
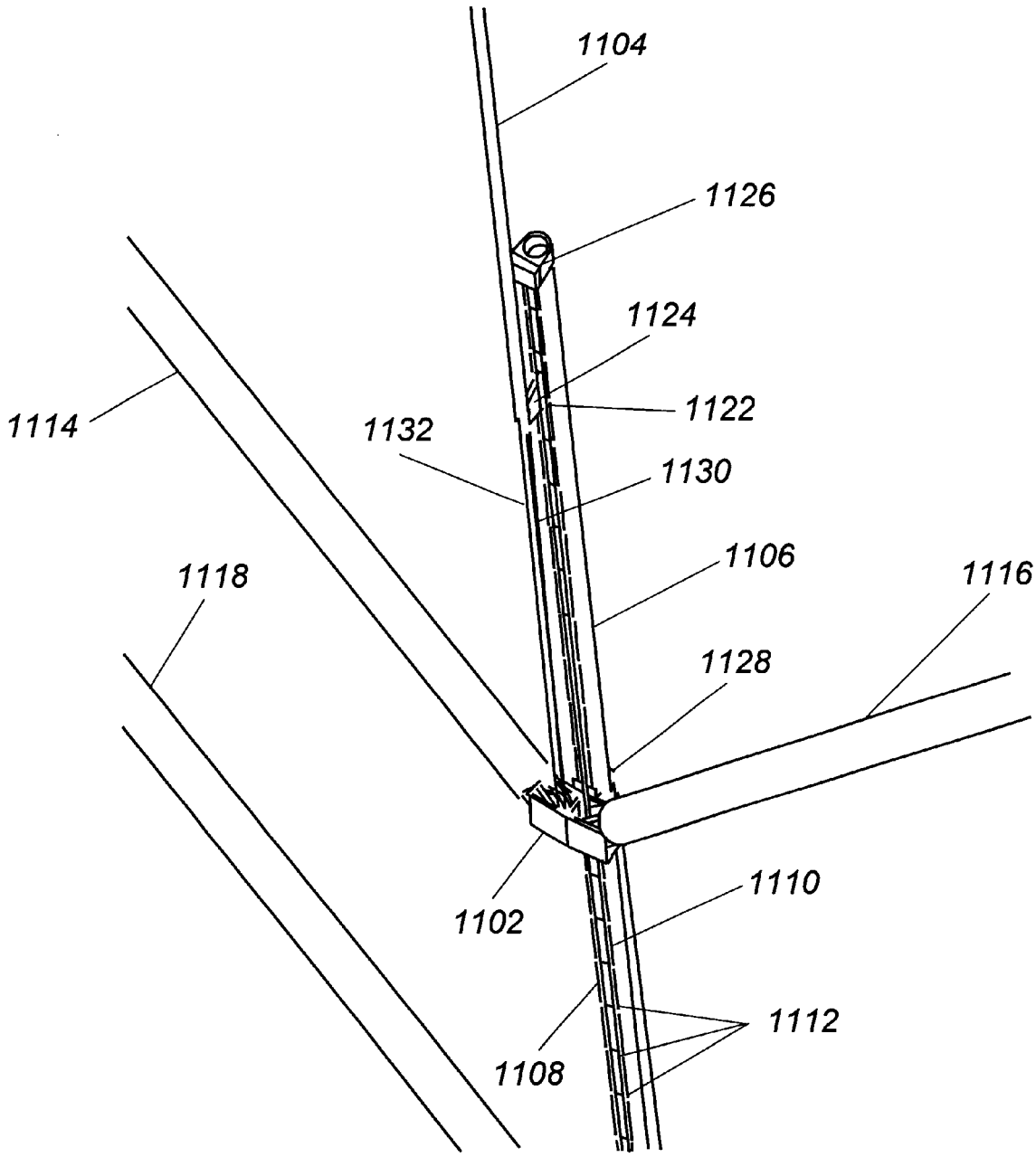

FIG. 11B shows another view of the translating joint 1102 and the translating extension spar 1104. Like reference numerals indicate like parts between FIGS. 11A and 11B. Note, however, that the translating extension spar 1104 need not always be disposed on the same side of the vertical support member 1106 as the left rail 1108 and right rail 1110. An implementation of a translating extension spar disposed on the opposite side as the rails may be found in FIG. 11C.

Figure 11C:
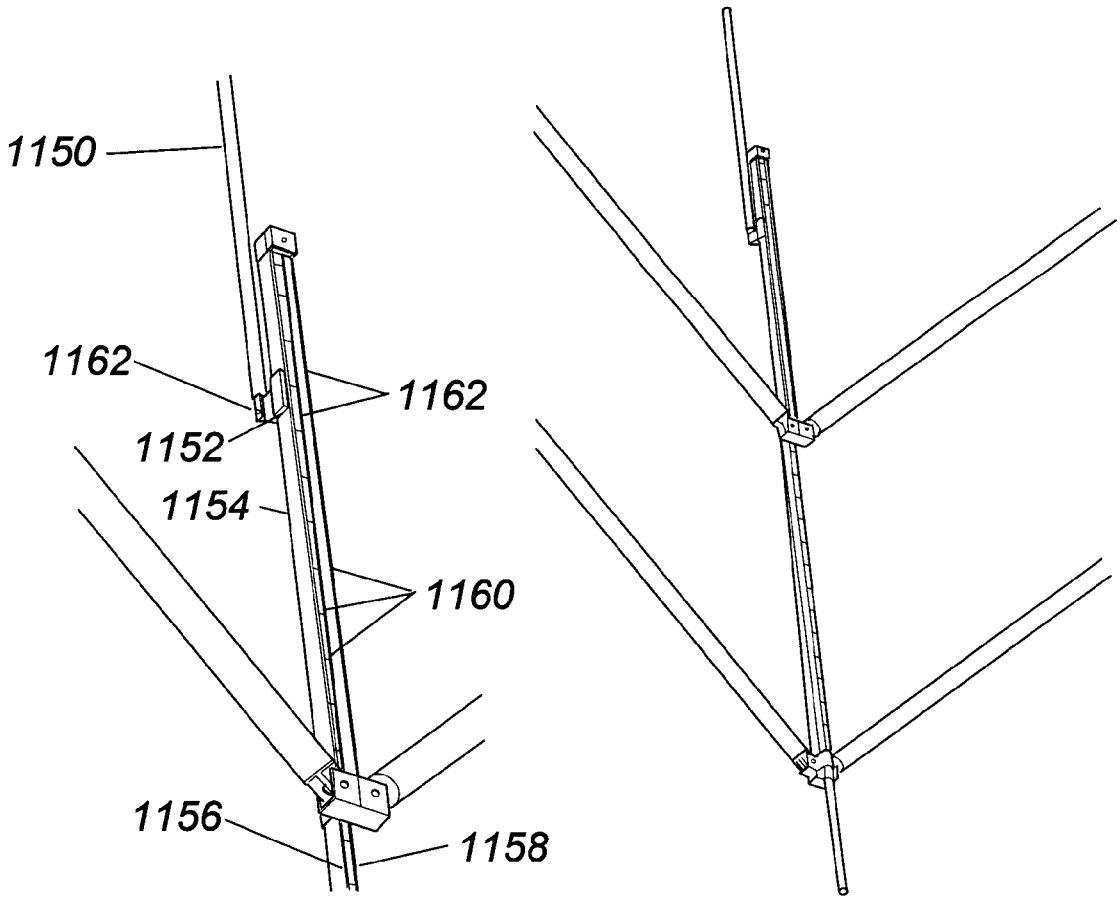

FIG. 11C shows an implementation of a translating extension spar 1150 riding on a miniature trolley 1152. The translating extension spar 1150 is disposed on the opposite side of a vertical support member 1154 to which a left rail 1156 and a right rail 1158 attach. In this case, the supporting clips 1160 couple to the inner sides of the left rail 1156 and the right rail 1158. Several cupped miniature trolley wheels (two of which are designated with reference numeral 1162) then ride along the left rail 1156 and the right rail 1158 during translation of the extension spar 1150.

Again, a clevis joint 1162 allows the translating extension spar 1150 to rotate into place. As noted above, the clevis joint 1162 preferably includes a stop that prevents the translating extension spar 1150 from rotating beyond a predetermined limit. The limit may vary depending on the application, but may be, for example, on the order of 30 degrees for a 50 foot diameter perimeter truss structure supporting an RF reflective surface.

Figure 12:
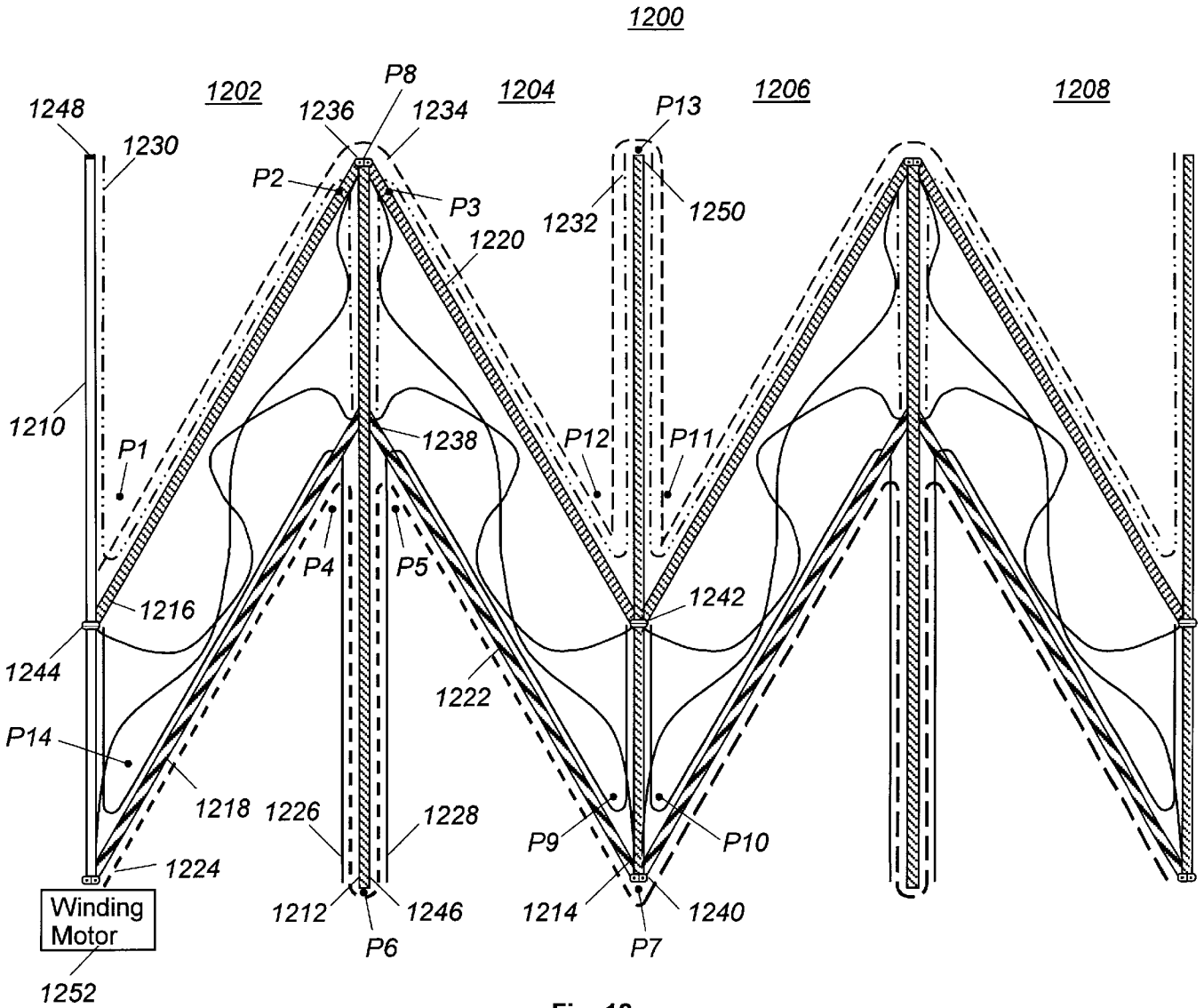
FIG. 12 illustrates the routing of a deployment cable, a redundant deployment cable, and synchronization cables through the translating and non-translating joints.

Turning next to FIG. 12, that figure illustrates a perimeter truss section 1200 and shows the manner in which deployment and synchronization cables run through the perimeter truss section 1200 and the perimeter truss structure 104 as a whole. Four partially collapsed bays 1202, 1204, 1206, and 1208 are present in FIG. 12. Because the deployment and synchronization cables are routed symmetrically between bays, the following discussion focuses only on the routing through the first bay 1202 and the second bay 1204, but is applicable to all the bays 106 in the perimeter truss structure 104.

The first bay 1204 includes a first hollow vertical support member 1210 and a second hollow vertical support member 1212. The second bay 1206 shares the second hollow vertical support member 1212 and also includes a third hollow vertical support member 1214. The first bay also includes a first upper horizontal support member 1216 and a first lower horizontal support member 1218. The second bay includes a second upper horizontal support member 1220 and a second lower horizontal support member 1222.

FIG. 12 shows the positioning of the deployment cable 1224 as well as optional lower synchronization cables 1226 and 1228 and optional upper synchronization cables 1230 and 1232. A second deployment cable 1234 is also illustrated. When sufficient guarantees of reliability exist, the perimeter truss structure may be opened with a single deployment cable (e.g., the deployment cable 1224). The optional synchronization cables 1226–1232 and second deployment cable 1234 provide a measure of protection against a broken deployment cable, as will be explained in more detail below.

Pulleys (or other rotating structures) are located where the deployment cables 1224 and 1234 and synchronization cables 1226–1232 turn. For example, pulleys are located approximately at the points labeled P1–P14 in FIG. 12. FIG. 12 exaggerates the turns in the cables for clarification. Thus, in reality, the pulleys P2, P3, and P8 are located closely together on a common fixed joint 1236, the pulleys P4 and P5 are located closely together on a common translating joint 1238. Similarly, the pulleys P7, P9, and P10 are located closely together on a common fixed joint 1240, while the pulleys P11 and P12 are located closely together on a common translating joint 1242. To this end, reference is made to the pulley structure shown in the translating joint 1004 shown in FIG. 10. The pulleys P6 and P13 are attached at ends of the vertical support members 1212 and 1214. The pulley P6, may, for example, correspond to the pulley 1126 in FIG. 11A.

With regard first to the deployment cable 1224, it is noted that the deployment cable 1224 runs inside the lower horizontal support member 1218 (which is hollow), over the pulley P4, and down the outside the vertical support member 1212. The deployment cable 1224 continues around the pulley P6, up the outside of the vertical support member 1212, and over the pulley P5. The deployment cable 1224 continues down the inside of the second lower horizontal support member 1222 (which is also hollow), under the pulley P7, and continues in the same fashion around the perimeter truss structure 104.

The second deployment cable 1234 is routed through the first upper horizontal support member 1216 (which is hollow), around the pulley P8, and through the second upper horizontal support member 1220 (which is also hollow). The second deployment cable 1234 continues around the pulley P12 and up the outside of the vertical support member 1214, around the pulley P13, and down the outside of the vertical support member 1214. The second deployment cable 1234 is routed around the pulley P11 and continues in the same fashion around the perimeter truss structure 104.

With regard to the synchronization cables, the first lower synchronization cable 1226 attaches to the translating joint 1244 and runs down the outside of the vertical support member 1210, around the pulley P14, and up the inside of the first lower horizontal support member 1218. The first lower synchronization cable 1226 continues around the pulley P4 and down the outside of the vertical support member 1212 to attach at the fixed joint 1246. It is noted that where two or more cables make a common turn, a pulley may be provided for each cable. Thus, the pulley P4 may in fact be replaced by a pulley for the first synchronization cable 1226 and a pulley for the deployment cable 1224.

The second lower synchronization cable 1228 is connected in a similar fashion. The second lower synchronization cable 1228 attaches to the fixed joint 1246, runs up the outside of the vertical support member 1212, and around the pulley P5. The second lower synchronization cable 1228 continues down the inside of the second lower horizontal support member 1222, around the pulley P9, and connects to the translating joint 1242. The synchronization cables may be attached by threading their ends and coupling them into a joint.

The upper synchronization cables 1230-1232 are routed in a manner symmetric with the lower synchronization cables 1226–1228. In particular, the first upper synchronization cable 1230 attaches to the fixed joint 1248, runs down the outside of the vertical support member 1210, and around the pulley P1. The first upper synchronization cable 1230 continues up the inside of the first upper horizontal support member 1216, around the pulley P2, and connects to the translating joint 1238.

The second upper synchronization cable 1232 attaches to the translating joint 1238 and runs up the outside of the vertical support member 1212, around the pulley P3, and down the inside of the second upper horizontal support member 1220. The second upper synchronization cable 1232 continues around the pulley P12 and up the outside of the vertical support member 1214 to attach at the fixed joint 1250.

In operation, a winding motor 1252 may be used to pull the deployment cables in onto a spool. When the deployment cable 1224 pulls in, the deployment cable 1224 exerts a downward force on the translating joint 1238 (as well as every other translating joint for the lower horizontal support members). The downward force begins to push the perimeter truss structure apart. Assuming, for example, that the second deployment cable 1234 is broken, then the upper synchronization cables 1230 and 1232 (which are coupled to the translating joint 1238), pull down, thereby exerting an upward force on the translating joints 1242 and 1244. Synchronism in the deployment of the upper and lower portions of the perimeter truss structure is thereby maintained.

A similar situation exists when the deployment cable 1224 is broken. Is this situation, the lower synchronization cables 1226–1228 are pulled up by the translating joints 1242 and 1244 due to the pulling in of the second deployment cable 1234. As a result, the lower synchronization cables exert a downward force on the translating joint 1238 to maintain deployment synchronism with the upper portion of the perimeter truss structure.

A single deployment cable 1224 is sufficient to pull the entire perimeter truss structure into deployment because the force it exerts is coupled through the perimeter truss structural members to the translating joints 1242 and 1244 as well. The deployment cables 1224 and 1234 and synchronization cables 1226–1232 may be formed from a high modulus, high tensile fiber, such as Kevlar™. As a result, the pulleys may be quite small, thereby reducing the size, weight, and cost of the perimeter truss structure 104.

With reference again to FIG. 2, it is noted that as the perimeter truss structure comes to final deployment, the shear lines 240 and 242 become tensioned to provide support for the horizontal and vertical support members 202–208. In addition, the hoop line 238 tensions up the pyramidal tension structure 226 to provide additional stiffness for the perimeter truss structure. Furthermore, the extension spar guy lines 218–224 pull into tension, and thereby move the extension spars 210–216 into final position, in much the same manner as guy lines on the mast of a sailing vessel.

The winding motor 1252 is generally under control of a satellite control system. Thus, when the satellite control system determines that the perimeter truss section masts have deployed (see FIGS. 17–21 discussed below), the satellite control system may instruct the winding motor 1252 to initiate deployment. In other words, the satellite control system may instruct the winding motor 1252 to begin pulling in the deployment cables.

Figure 13:
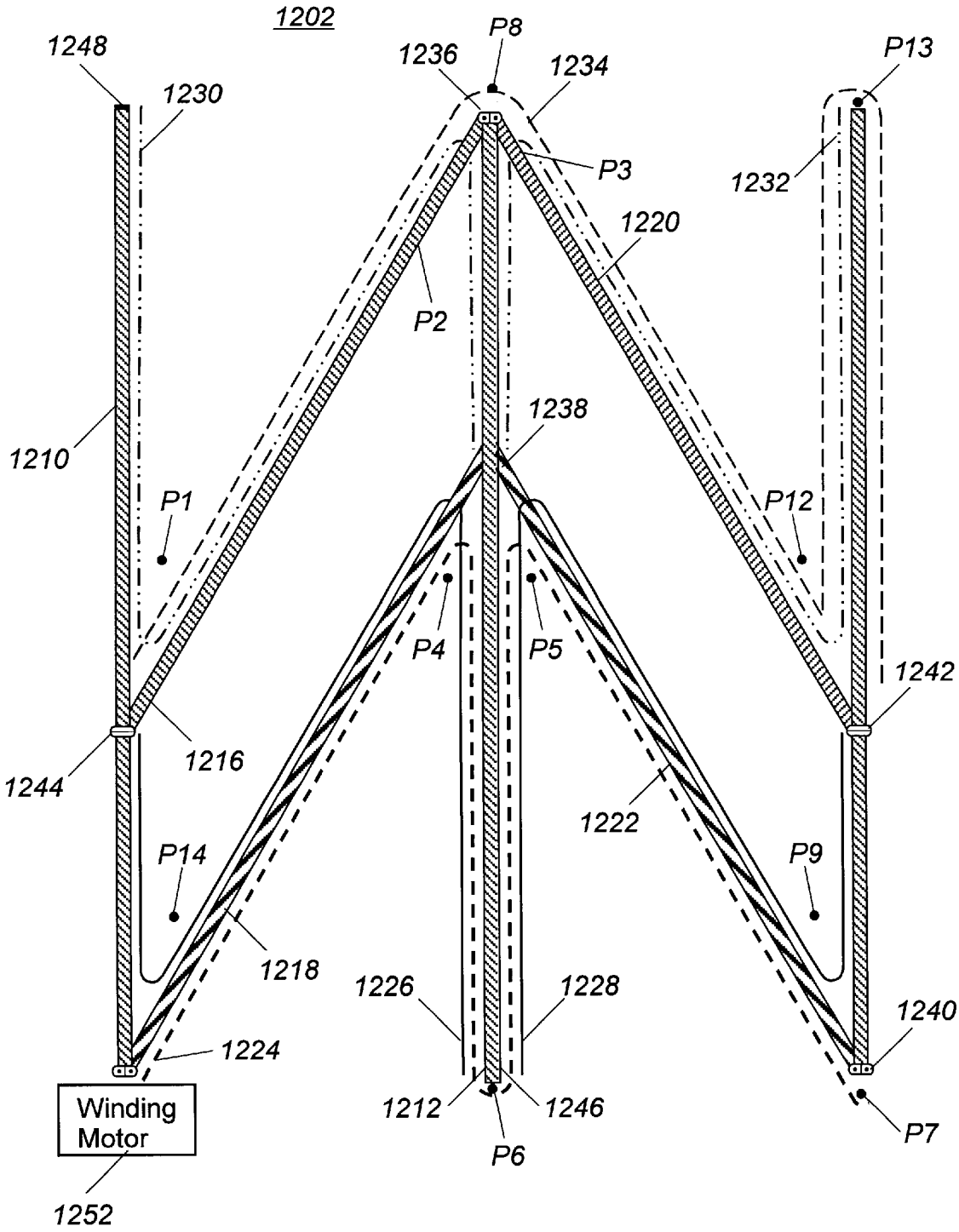
FIG. 13 illustrates the routing of additional synchronization cables through the translating and non-translating joints.

A larger view of the deployment structure described above may be seen in FIG. 13. FIG. 13 provides an enlarged view of the partially deployed bays 1202 and 1204, including the associated deployment cables 1224 and 1234 and synchronization cables 1226–1232. Like reference characters are used for like parts between FIGS. 12 and 13.

Figure 14:
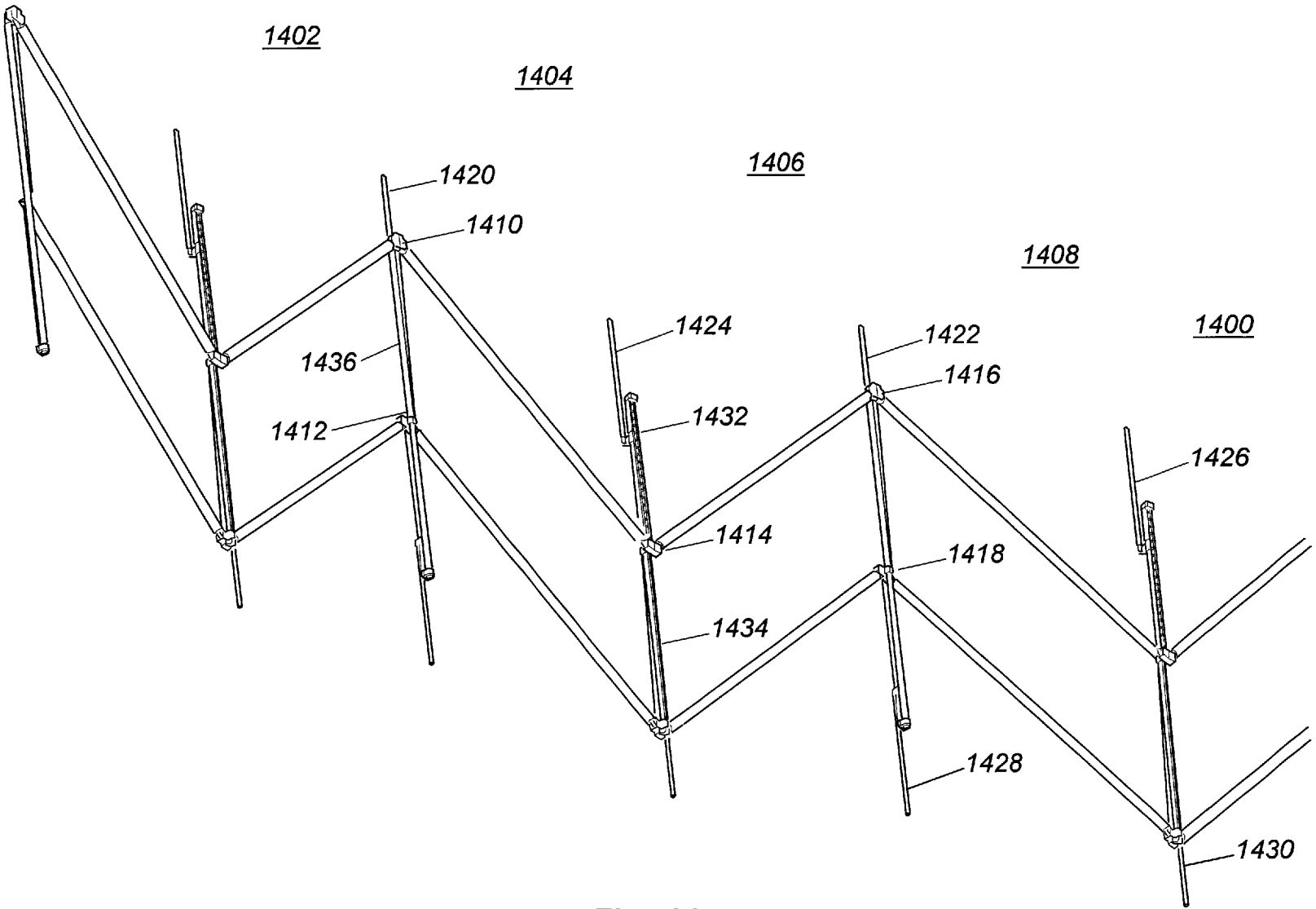
FIG. 14 shows a perspective view of extension spar deployment for several bays.

As noted above, the perimeter truss structure 104 may be used with or without the extension spars 112. Turning next to FIG. 14, that figure illustrates a perimeter truss section 1400 configured with extension spars. In particular, FIG. 14 shows partially collapsed bays 1402, 1404, 1406, and 1408. The bays 1402 and 1404 share the fixed joint 1410 and the sliding joint 1412. The bays 1404 and 1406 share the sliding joint 1414. The bays 1406 and 1408 share the fixed joint 1416 and the sliding joint 1418.

FIG. 14 also shows upper telescoping extension spars 1420 and 1422, that alternate with upper translating extension spars 1424 and 1426. Similarly, FIG. 14 illustrates a lower translating extension spar 1428 alternating with a lower telescoping extension spar 1430. In other words, where there is an upper translating extension spar, there is a corresponding lower telescoping extension spar, and vice versa. Translating extension spars alternate with telescoping extension spars around the upper and lower portions of the perimeter truss structure 104. The extension spars are preferably formed from a low CTE graphite resin system. Although the following discussion is directed specifically to the translating extension spar 1424 and the telescoping extension spar 1420, it is noted that the same principles apply to each translating extension spar and each telescoping extension spar in the perimeter truss structure 104.

As noted above with regard to FIG. 11, the translating extension spar 1424 may, for example, ride on a miniature trolley 1432. To that end, rails are provided along the vertical support member 1434 over the length of travel of the translating extension spar 1424. The wheels of the trolley 1432 may then ride along the rails to allow the translating extension spar 1424 to extend during deployment. The trolley 1432 is preferably coupled to the translating joint 1414 using a pulley system, as was described above in more detail.

As the curvature of the RF reflective structure increases, so too does the overall height required from the supporting perimeter truss structure. Thus, where the translating extension spar 1424 needs to be approximately as long as the vertical support member 1434, the translating extension spar 1424 may instead connect directly to the translating joint 1414.

The telescoping extension spar 1420 is coupled through a pulley system to the fixed joint 1410. The telescoping extension spar 1420 may be formed using a series of sliding tubes disposed within one another, in much the same way as a automobile antenna. Thus, the telescoping extension spar 1420 may initially be packed into the vertical support member 1436. A pulley inside the telescoping extension spar 1420 then couples the forces generated upon deployment of the perimeter truss structure 104 to the telescoping extension spar 1420, and in particular, to the sliding tubes.

In some instances, the telescoping extension spar 1420 may be replaced with a double telescoping extension spar that allows rotation of the telescoping extension spar 1420. In particular, the double telescoping structure allows one end of the telescoping extension spar 1420 to rotate into position (guided by extension spar guide lines) as the perimeter truss structure deploys.

As an alternative, the telescoping extension spars may be spring loaded to produce the extension force.

As noted above, the extension spars may support a surface.

Figure 15A:
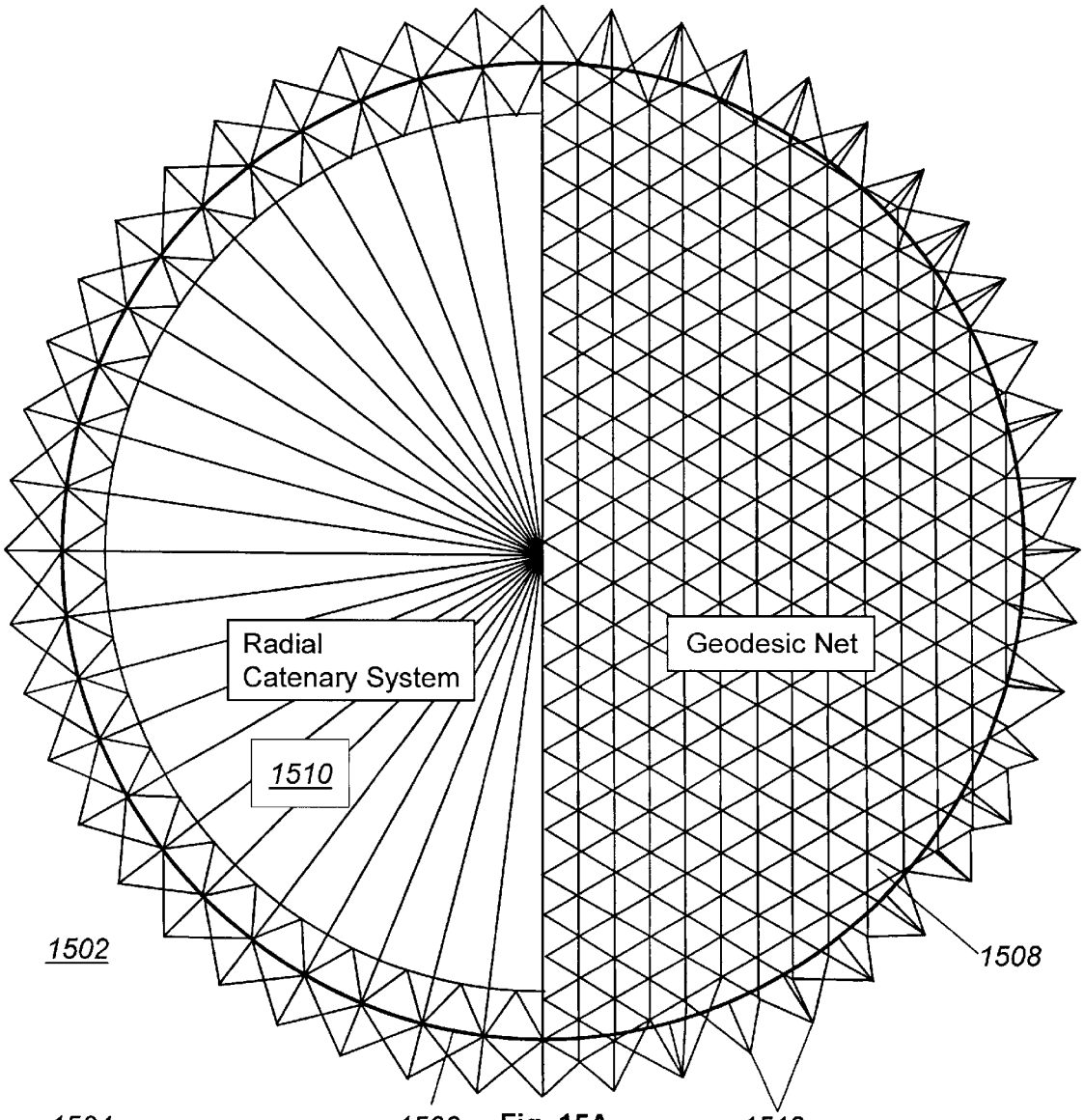
FIG. 15A–B show a top down wire frame view and a side wire frame view of a deployed perimeter truss structure.
Figure 15B:
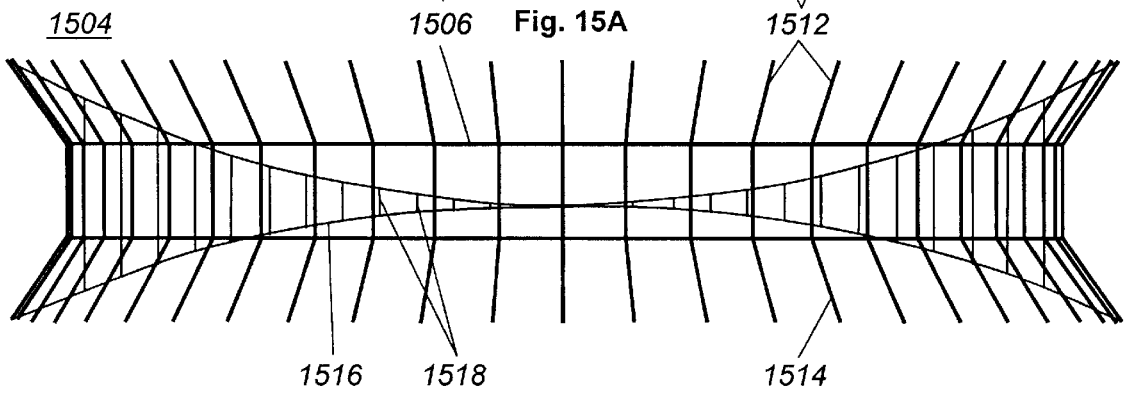

Turning next to FIG. 15, that figure illustrates a top view 1502 and a side view 1504 of a perimeter truss structure 1506 supporting, alternatively, a geodesic net 1508 or a radial caternary system 1510. Either the geodesic net 1508 or radial caternary 1510 are used to support an elastic RF reflective surface such as knit wire mesh. The perimeter truss structure includes upper extension spars 1512 and lower extension spars 1514.

The caternary system 1506 and geodesic net 1508 may be attached to the upper extension spars 1512 using screws. As an example, a number 2 screw may be used in many instances when the diameter of the perimeter truss structure is approximately 10 meters or less, although screws up to a number 6 may be used depending on the load to be borne by the extension spars. In addition, a shaping surface 1516 may be connected to the lower extension spars 1514 using screws as well. The shaping surface 1516 pulls the geodesic net 1508 into shape using numerous drop ties 1518.

Figure 16:
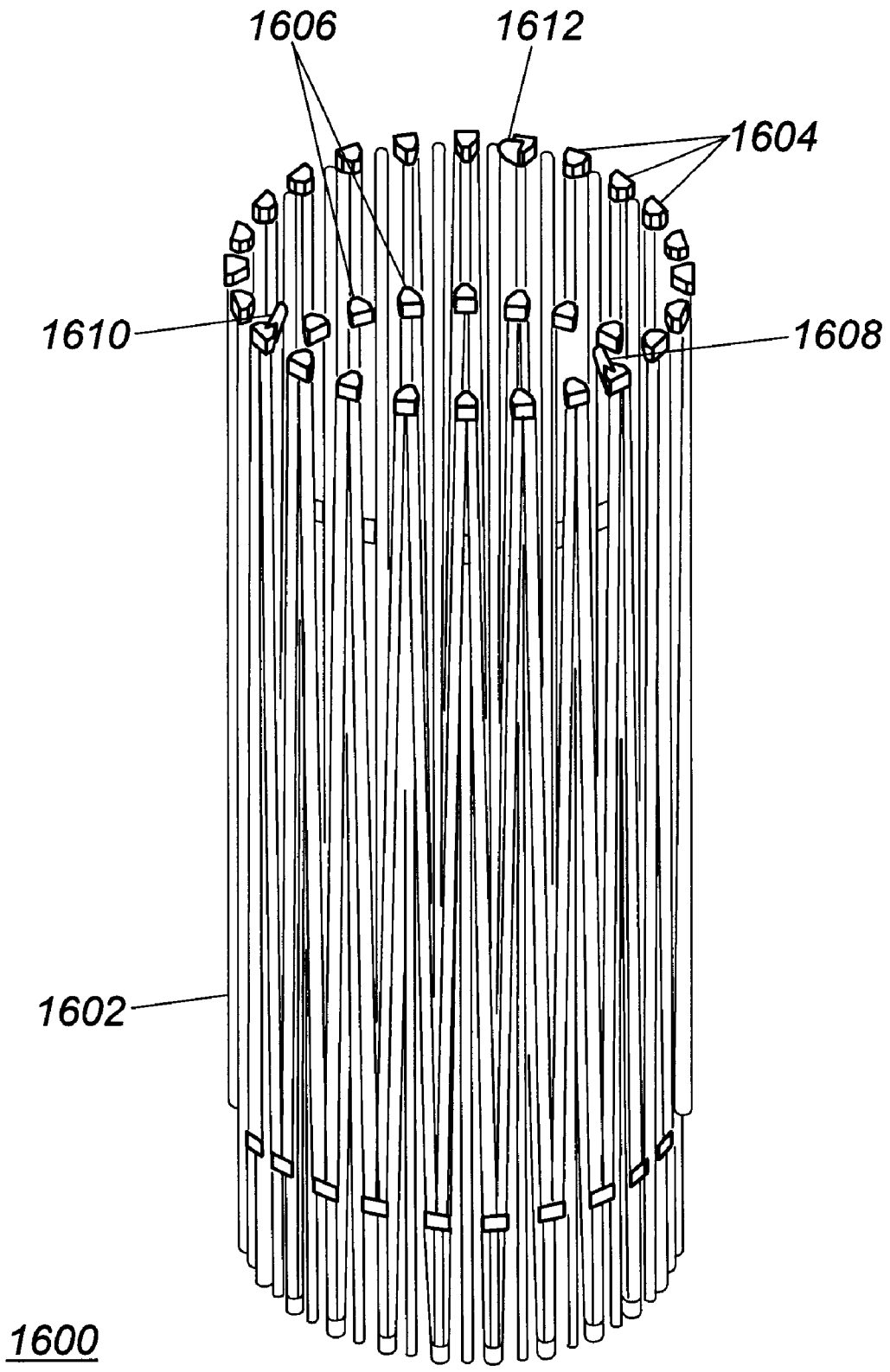
FIG. 16 illustrates an isometric view of a stowed perimeter truss structure.

As noted above, and shown in top view in FIG. 9, the perimeter truss structure forms a very dense stowed configuration. Turning next to FIG. 16, that figure illustrates an isometric view 1600 of a stowed perimeter truss structure 1602. For illustration purposes, several fixed joints are designated with reference numeral 1604 and several translating joints are designated with reference number 1606. In addition, FIG. 16 shows the location of three latches 1608, 1610, and 1612 that may be used to attach and support a structure inside the perimeter truss structure (e.g., a spool on which the RF reflective surface unwinds).

It is further noted that the fittings at the ends of the fixed joints 1604 are preferably cup and cone fittings configured to remove five of six different degrees of freedom from the horizontal and vertical support members. A band around the outside of the fittings may then encircle the perimeter truss structure fittings and eliminate the final degree of freedom. Thus, the entire bundle of horizontal and vertical support members acts like a single "barrel," rather than a collection of dozens of independent smaller members. Explosive charges remove the band before the perimeter truss structure is deployed.

Figure 17:
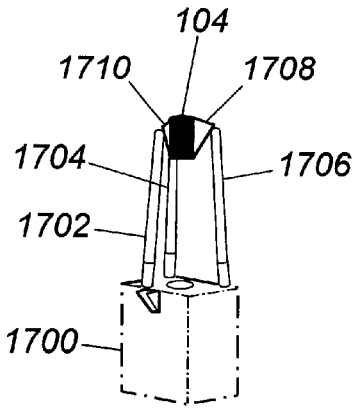
FIGS. 17–21 illustrate deployment of the perimeter truss structure from a satellite.

FIGS. 17–21 illustrate one technique that may be used to deploy the perimeter truss structure 104. Turning first to FIG. 17, that figure illustrates a satellite 1700 including a first deployable mast 1702, a second deployable mast 1704, and a third deployable mast 1706. The deployable masts 1702–1706 may be formed from a gas inflated rubber and graphite material that hardens when cold. Such masts are available, for example, from L'Garde Company. The inflatable masts 1702–1706 attach to the perimeter truss structure 104 using three brackets, two of which are shown and designated 1708 and 1710.

Figure 18:
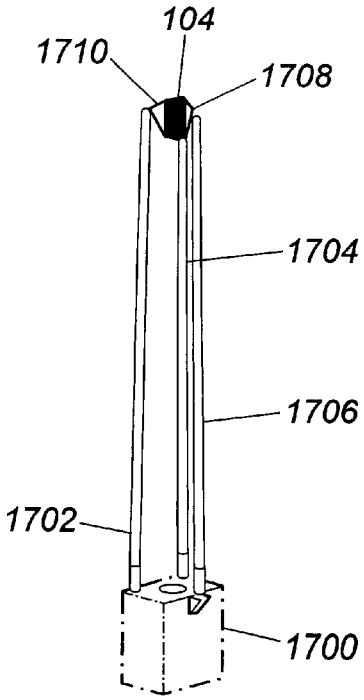
Figure 19:
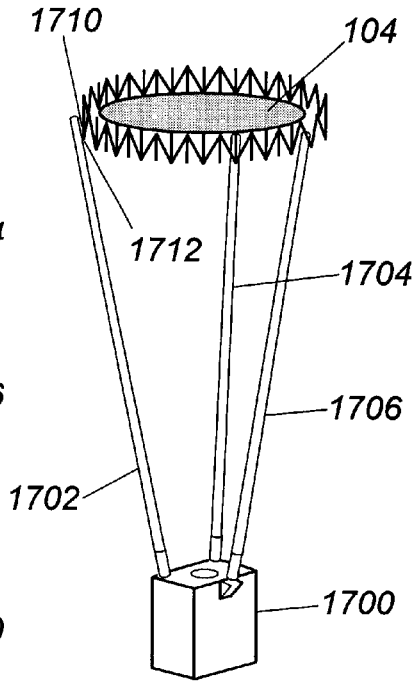

As the inflatable masts 1702–1706 deploy, the perimeter truss structure 104 is carried farther away from the satellite 1700 (FIG. 18). When the inflatable masts 1702–1706 are fully inflated, the perimeter truss structure begins to open (FIG. 19). At this point, for example, the satellite control system may instruct the winding motor 1252 to begin to pull in the deployment cable 1224. The perimeter truss structure 104 is thus shown in FIG. 19 as partially deployed. Note also, however, that each bracket provides the clearance required between the inflatable masts 1702–1706 and the perimeter truss structure 104. Thus, for example, the bracket 1710 provides the clearance 1712 for the inflatable mast 1702.

Figure 20:
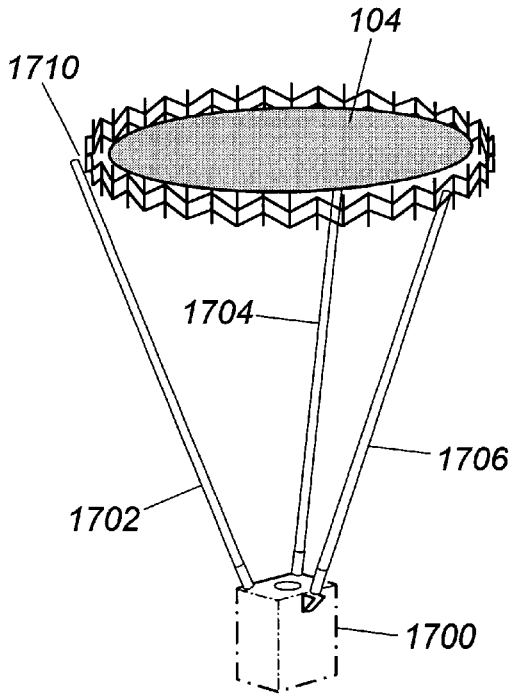
Figure 21:
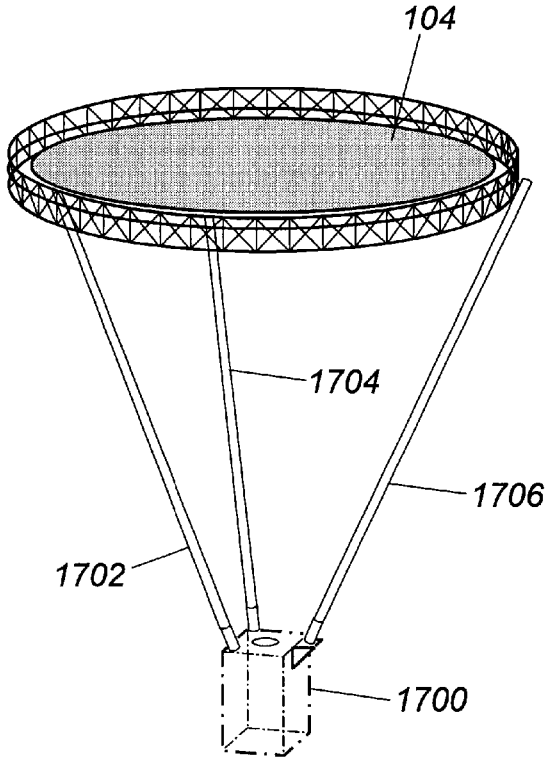

The perimeter truss structure 104 continues to deploy. FIG. 20 illustrates a second intermediate deployment stage, while FIG. 21 illustrates the fully deployed perimeter truss structure. Like reference characters in FIGS. 17–21 indicate like elements between Figures.

Figure 22:
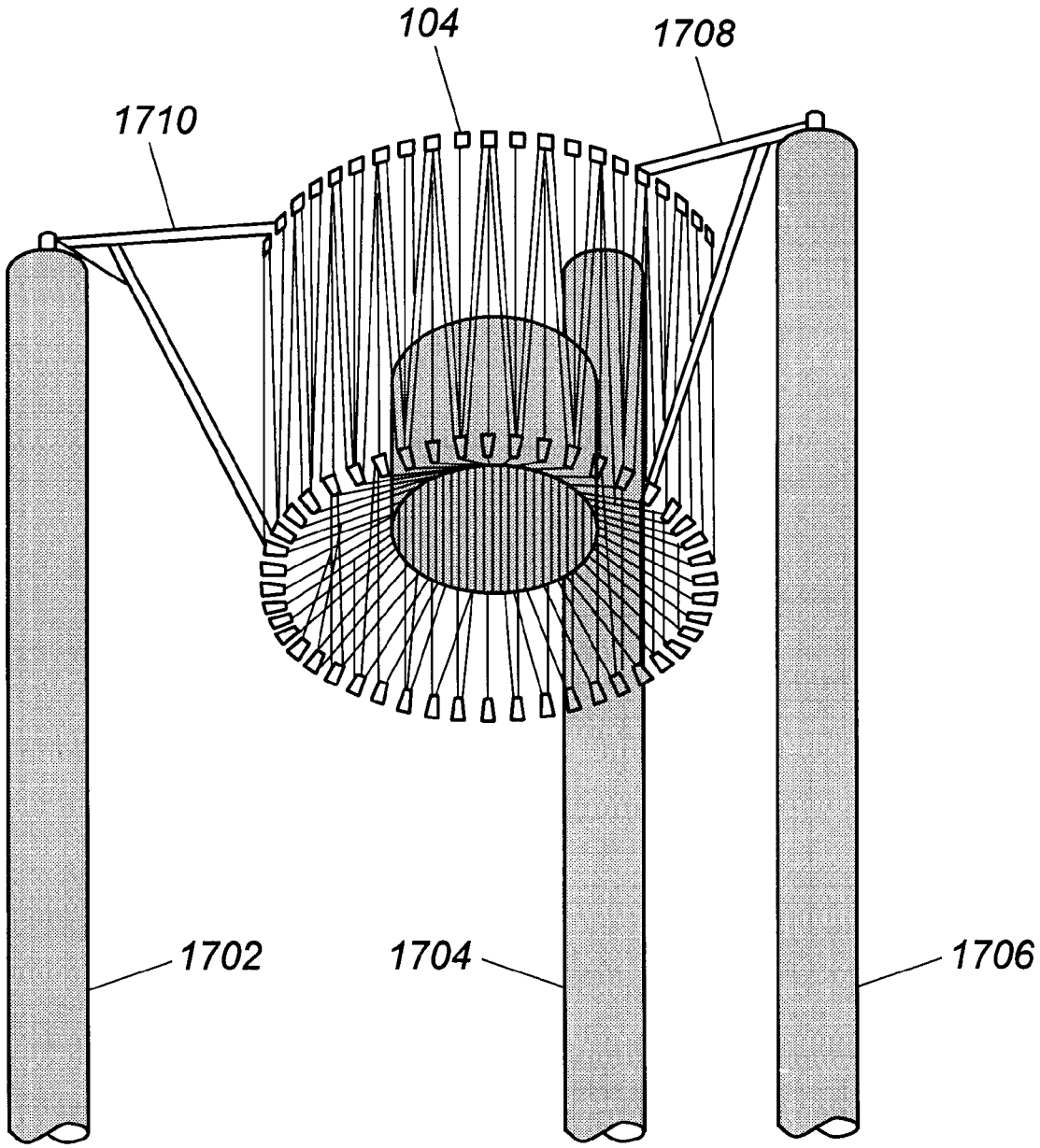
FIG. 22 shows a closer view of mast attachment to a perimeter truss structure.

With reference now to FIG. 22, a closer view of the inflatable mast 1702–1706 attachment to the perimeter truss structure 104 is shown. In particular, FIG. 22 shows an enlarged view of the hangar style brackets 1708 and 1710 (a third bracket is hidden behind the perimeter truss structure 104). In addition to the brackets 1708 and 1710, deploying tension cables (not shown) are preferably used to remove torsion effects that tend to sway the perimeter truss structure 104 side to side. It is noted that different applications may use different deploying techniques. Thus, for example, a single boom may in some cases deploy the perimeter truss structure 104.

In one implementation, the perimeter truss structure is approximately 50 feet in diameter when fully deployed. The vertical support members may then be approximately 3.5 feet long, with a diameter of approximately 1 inch. The horizontal support members may be approximately 3 feet long, with a diameter of approximately 1.5 inches. The upper and lower extension spars may be approximately 3.5 feet long, and have a diameter of approximately 1 inch.

The joints, pulleys, and associated structures may be formed from a variety of materials, preferably with a low CTE. As one example, the joints and pulleys may be formed from machined Aluminum or Titanium. As another example, the joints and pulleys may be formed using a graphite fiber or resin, either molded or created using a hand layup. In addition, although the translating joints are preferably implemented with cupped wheels riding along tracks, the translating joint may also be implemented using an outer tube structure that slides along an inner tube structure (e.g., a vertical support member). The region along which the sliding joint travels is preferably coated with a low friction surface such as Teflon™ to reduce friction and binding propensity.

Thus, the present perimeter truss structure provides a lightweight and inexpensive support structure for space-born reflectors that folds into a very compact volume. The present design is also much more cost effective to manufacture. The present design folds into a volume only one tenth the volume and only one quarter of the weight of previous designs, leading directly to significantly reduced cost to launch.

While the invention has been described with reference to a preferred embodiment, it will be understood by those skilled in the art that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. A perimeter truss structure for a reflector, the truss structure comprising:

a plurality of deployed bays arranged in a ring, each deployed bay comprising:

a first upper horizontal support member attached to a first vertical support member and collapsible on a first joint translating on a second vertical support member; and a first lower horizontal support member attached to the second vertical support member and collapsible on a second joint translating on the first vertical support member.

2. The perimeter truss structure of claim 1, wherein the first and second vertical support members define first and second opposite ring sides, the first upper horizontal support member is disposed on the first ring side, and the first lower horizontal support member is disposed on the second ring side.

3. The perimeter truss structure of claim 2, wherein the first and second opposite ring sides are a ring inside and a ring outside, and wherein the first upper horizontal support member is disposed on the ring outside.

4. The perimeter truss structure of claim 1, further comprising a first extension spar coupled to the first joint, the first extension spar extending down and away from the ring.

5. The perimeter truss structure of claim 1, further comprising a third vertical support member, a second upper horizontal support member attached to the third vertical support member and collapsible on the first joint translating on the second vertical support member, and a second lower horizontal support member attached to the second vertical support member and collapsible on a third joint translating on the third vertical support member.

6. The perimeter truss structure of claim 5, further comprising a second extension spar coupled to the second joint, the second extension spar extending up and away from the ring.

7. The perimeter truss structure of claim 5, wherein the first vertical support member is shared between a first deployable bay adjacent to a second deployable bay, and the third vertical support member is shared between the second deployable bay and an adjacent third deployable bay, the first, second, and third deployable bays included in the plurality of deployable bays.

8. The perimeter truss structure of claim 5, further comprising shear lines cross connected between the first upper horizontal support member and the first lower horizontal support member.

9. The perimeter truss structure of claim 1, wherein each deployable bay further comprises cross connected shear lines.

10. The perimeter truss structure of claim 4, wherein the first extension spar is coupled to a clevis joint allowing the extension spar to travel along a predetermined amount of rotation.

11. The perimeter truss structure of claim 6, further comprising an extension spar guy line connected between the second extension spar and a second end of the first upper horizontal support member.

12. The perimeter truss structure of claim 1, wherein the first upper horizontal support member and the first lower horizontal support member are hollow.

13. The perimeter truss structure of claim 12, further comprising at least one deployment cable routed through the first upper horizontal support member and at least one synchronization cable routed through the first lower horizontal support member.

14. The perimeter truss structure of claim 13, further comprising a hoop tension line running around a ring inside, the hoop tension line coupled to each of the deployable bays through a tension line truss structure.

15. The perimeter truss structure of claim 14, wherein the tension line truss structure is a pyramidal tension line truss structure.

16. A deployable bay for an antenna support structure, the bay comprising:

an upper horizontal support member attached to a first vertical support member and collapsible on a first joint translating on a second vertical support member;

a lower horizontal support member attached to the second vertical support member and collapsible on a second joint translating on the first vertical support member;

wherein the first and second vertical support members define a bay inside and a bay outside, and wherein the upper horizontal support member is disposed on the bay outside and the lower horizontal support member is disposed on the bay inside, wherein the lower horizontal support member and the upper support member are collapsible without interference therebetween;

a first extension spar extending up and into the bay outside and coupled to the first joint; and a second extension spar extending down and into the bay outside and coupled to the second joint.

17. The deployable bay of claim 16, further comprising a third extension spar extending up and into the bay outside and a fourth extension spar extending down and into the bay outside.

18. The deployable bay of claim 16, further comprising a first extension spar guy line connected between the first extension spar and a first end of the lower horizontal support member and a second extension spar guy line connected between the second extension spar and a second end of the upper horizontal support member.

19. The deployable bay of claim 17, further comprising a first extension spar guy line connected between the first extension spar and a first end of the lower horizontal support 4 member, a second extension spar guy line connected between the second extension spar and a second end of the upper horizontal support member, a third extension spar line connected between the third extension spar and a second end of the lower horizontal support member and a fourth extension spar guy line connected between the fourth extension spar and a second end of the upper horizontal support member.

20. The deployable bay of claim 16, further comprising first shear lines cross connected between opposite ends of the upper horizontal support members and the lower horizontal support members.

21. The deployable bay of claim 16, wherein at least one of the first and second extension spars is coupled to a translating clevis joint.

22. The deployable bay of claim 21, wherein the clevis joint stops rotation of the second extension spar beyond a predetermined angle.

23. The deployable bay of claim 17, wherein at least two of the first, second, third, and fourth extension spars are coupled to translating clevis joints.

24. The deployable bay of claim 23, wherein the clevis joints stop rotation at the same predetermined angle.

25. The deployable bay of claim 16, further comprising a plurality of truss lines connected together at an apex and having second ends connected to the first and second vertical support members to form a pyramidal tensioning structure.

26. A deployable perimeter truss structure comprising:

a plurality of collapsed bays arranged in a ring, the plurality of collapsed bays including at least first, second, and third vertical support members delineating a first bay and a second bay, the second vertical support member shared between the first bay and second bay, the first bay including a first upper horizontal support member attached to the first vertical support member and collapsible on a first joint translating on the second vertical support member and a first lower horizontal support member attached to the second vertical support member and collapsible on a second joint translating on the first vertical support member;

the second bay including a second upper horizontal support member attached to the third vertical support member and collapsible on the first joint translating on the second vertical support member and a second lower horizontal support member attached to the second vertical support member and collapsible on a third joint translating on the third vertical support member;

first and second pulleys riding with the first joint;

a third pulley at a first end of the second vertical support member, a fourth pulley at a first end of the third vertical support member, and a fifth pulley at a first end of the first vertical support member;

a deployment cable running over the third, fourth, and fifth pulleys and under the first and second pulleys; and a winding motor for pulling in the deployment cable to lift the first joint into a deployed position.

27. The deployable perimeter truss structure of claim 26, further comprising a synchronization cable connected between the upper horizontal support members and the lower horizontal support members.

28. The deployable perimeter truss structure of claim 27, further comprising a sixth pulley riding with the second joint, seventh and eighth pulleys adjacent to a second end of the second vertical support member, and a ninth pulley riding with the third joint.

29. The deployable perimeter truss structure of claim 26, wherein the first and second horizontal support members are hollow, and the deployment cable runs inside the first and second horizontal support members.

30. The perimeter truss structure of claim 26, further comprising shear lines cross connected between the first upper horizontal support member and the first lower horizontal support member.

31. The perimeter truss structure of claim 30, wherein each collapsed bay further comprises cross connected shear lines.

32. The deployable perimeter truss structure of claim 26, wherein at least one of the first, second, and third joints comprises a miniature trolley for translational motion.

33. The deployable perimeter truss structure of claim 32, wherein the miniature trolley comprises cupped wheels riding on at least first and second tracks along the length of at least one of the first, second, and third vertical support members.

34. The deployable perimeter truss structure of claim 26, further comprising at least one of a caternary system and geodesic net for providing an RF reflective surface, the caternary system coupled to a plurality of extension spars coupled to the vertical support members.

35. The deployable bay of claim 34, further comprising a first extension spar guy line connected between a first upwardly extending extension spar and a first end of the first lower horizontal support member and a second extension spar guy line connected between a second upwardly extending extension spar and a second end of the first lower horizontal support member.

36. The deployable perimeter truss structure of claim 26, wherein the first, second, and third vertical support members define first and second opposite ring sides, the first upper horizontal support member is disposed on the first ring side, and the first lower horizontal support member is disposed on the second ring side.

37. The deployable perimeter truss structure of claim 36, wherein the second upper horizontal support member is disposed on the first ring side, and the second lower horizontal support member is disposed on the second ring side.

* * * * *